US010443008B2

(12) United States Patent
Brabez et al.

(10) Patent No.: US 10,443,008 B2
(45) Date of Patent: Oct. 15, 2019

(54) MARINE LUBRICATING OILS AND METHOD OF MAKING AND USE THEREOF

(71) Applicant: ExxonMobil Research and Engineering Company, Annandale, NJ (US)

(72) Inventors: Nabila Brabez, Logan Township, NJ (US); Kevin L. Crouthamel, Hume, VA (US); John T. Fogarty, Swedesboro, NJ (US); Andrew D. Satterfield, Hockessin, DE (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/013,230

(22) Filed: Jun. 20, 2018

(65) Prior Publication Data

US 2019/0016983 A1 Jan. 17, 2019

Related U.S. Application Data

(60) Provisional application No. 62/523,406, filed on Jun. 22, 2017.

(51) Int. Cl.

| | |
|---|---|
| ***C10M 107/02*** | (2006.01) |
| ***C10M 169/04*** | (2006.01) |
| ***C10M 129/50*** | (2006.01) |

(52) U.S. Cl.

CPC ..... *C10M 107/02* (2013.01); *C10M 129/50* (2013.01); *C10M 169/04* (2013.01); (Continued)

(58) Field of Classification Search

CPC ..... C10N 2240/102; C10N 2230/52; C10N 2230/10; C10N 2230/04; C10N 2230/02; (Continued)

(56) References Cited

U.S. PATENT DOCUMENTS

| | | | |
|---|---|---|---|
| 3,382,291 | A | 5/1968 | Brennan |
| 3,742,082 | A | 6/1973 | Brennan |

(Continued)

FOREIGN PATENT DOCUMENTS

| | | | |
|---|---|---|---|
| JP | 1168798 | A | 7/1989 |
| WO | 201194575 | A1 | 8/2011 |

(Continued)

OTHER PUBLICATIONS

The International Search Report and Written Opinion of PCT/US2018/038704 dated Sep. 14, 2018.

(Continued)

*Primary Examiner* — Vishal V Vasisth
(74) *Attorney, Agent, or Firm* — Robert A. Migliorini

(57) ABSTRACT

Provided are marine lubricating oils including from 15 to 95 wt % of a Group III base stock having a kinematic viscosity at 100 deg. C. of 4 to 12 cSt, 0.5 to 55 wt % of cobase stock having a kinematic viscosity at 100 deg. C. of 29 to 1000 cSt, 0.1 to 2.0 wt % of a molydithiocarbamate friction modifier, 0.1 to 2.0 wt % of a zinc dithiocarbamate anti-wear additive, and 2 to 30 wt % of other lubricating oil additives. The cobase stock is selected from the group consisting of a Group I, a Group IV, a Group V and combinations thereof. Also provided are methods of making and using the marine lubricating oils.

18 Claims, 19 Drawing Sheets

(52) U.S. Cl.
CPC ..... *C10M 2203/1006* (2013.01); *C10M 2203/1025* (2013.01); *C10M 2203/1085* (2013.01); *C10M 2205/0265* (2013.01); *C10M 2205/0285* (2013.01); *C10M 2205/173* (2013.01); *C10M 2207/028* (2013.01); *C10M 2207/262* (2013.01); *C10M 2209/0845* (2013.01); *C10M 2219/046* (2013.01); *C10M 2219/068* (2013.01); *C10M 2223/045* (2013.01); *C10N 2210/01* (2013.01); *C10N 2220/022* (2013.01); *C10N 2230/02* (2013.01); *C10N 2230/04* (2013.01); *C10N 2230/06* (2013.01); *C10N 2230/10* (2013.01); *C10N 2230/52* (2013.01); *C10N 2230/54* (2013.01); *C10N 2230/56* (2013.01); *C10N 2240/102* (2013.01)

(58) Field of Classification Search
CPC .. C10M 2203/1006; C10M 2203/1025; C10M 2203/1085; C10M 2205/0265; C10M 2205/0285; C10M 2205/173; C10M 2207/028; C10M 2207/262; C10M 2209/0845; C10M 2219/068; C10M 2223/045
See application file for complete search history.

(56) References Cited

U.S. PATENT DOCUMENTS

| | | | |
|---|---|---|---|
| 3,769,363 | A | 10/1973 | Brennan |
| 3,876,720 | A | 4/1975 | Heilman et al. |
| 4,149,178 | A | 4/1979 | Estes |
| 4,218,330 | A | 8/1980 | Shubkin |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,434,408 | A | 2/1984 | Baba et al. |
| 4,827,064 | A | 5/1989 | Wu |
| 4,827,073 | A | 5/1989 | Wu |
| 4,906,799 | A | 3/1990 | Forbus, Jr. et al. |
| 4,910,355 | A | 3/1990 | Shubkin et al. |
| 4,912,272 | A | 3/1990 | Wu |
| 4,943,383 | A | 7/1990 | Avery et al. |
| 4,956,122 | A | 9/1990 | Watts et al. |
| 4,990,709 | A | 2/1991 | Wu |
| 5,012,020 | A | 4/1991 | Jackson et al. |
| 5,057,235 | A | 10/1991 | Famg et al. |
| 5,068,487 | A | 11/1991 | Theriot |
| 5,104,579 | A | 4/1992 | Benjamin et al. |
| 5,132,478 | A | 7/1992 | Ho et al. |
| 5,146,021 | A | 9/1992 | Jackson et al. |
| 5,208,403 | A | 5/1993 | Buchanan et al. |
| 5,243,114 | A | 9/1993 | Johnson et al. |
| 5,254,274 | A | 10/1993 | Ho et al. |
| 5,264,642 | A | 11/1993 | Wu |
| 5,382,739 | A | 1/1995 | Atkins et al. |
| 6,080,301 | A | 6/2000 | Berlowitz et al. |
| 6,090,989 | A | 7/2000 | Trewella et al. |
| 6,165,949 | A | 12/2000 | Berlowitz et al. |
| 6,339,051 | B1 | 1/2002 | Carey et al. |
| 8,921,291 | B2 | 12/2014 | Wu et al. |
| 9,365,663 | B2 | 6/2016 | Wu et al. |
| 2003/0171228 | A1 | 9/2003 | Deckman et al. |
| 2003/0191032 | A1 | 10/2003 | Deckman et al. |
| 2006/0276355 | A1 | 12/2006 | Carey et al. |
| 2007/0298990 | A1* | 12/2007 | Carey ..... C10M 111/04 508/591 |
| 2008/0318818 | A1 | 12/2008 | Mayhew et al. |
| 2009/0036725 | A1 | 2/2009 | Wu et al. |
| 2010/0152082 | A1* | 6/2010 | Price ..... C10M 143/10 508/508 |
| 2011/0094562 | A1 | 8/2011 | Carey et al. |
| 2011/0094575 | A1 | 8/2011 | Crouthamel et al. |
| 2011/0195878 | A1 | 8/2011 | Tellier et al. |
| 2011/0195882 | A1 | 8/2011 | Carey et al. |
| 2011/0195883 | A1 | 8/2011 | Tellier et al. |
| 2011/0195884 | A1* | 8/2011 | Crouthamel ..... C10M 169/04 508/391 |
| 2011/0207639 | A1 | 8/2011 | Carey et al. |
| 2014/0235516 | A1 | 8/2014 | Lancon |
| 2014/0274849 | A1 | 9/2014 | Lee et al. |
| 2014/0378355 | A1 | 12/2014 | Matsui et al. |

FOREIGN PATENT DOCUMENTS

| | | | |
|---|---|---|---|
| WO | 201194582 | A1 | 8/2011 |
| WO | 201457641 | A1 | 4/2014 |
| WO | 2015147269 | A1 | 10/2015 |
| WO | 2015147270 | A1 | 10/2015 |

OTHER PUBLICATIONS

Vipper et al., "Tribological Performance of Molybdenum and Zinc Dithiocarbamates and Dithiophosphates", Lubrication Science, 11, 1999, 187-196.

* cited by examiner

Figure 2

| Name | Comparative Example 1 | Comparative Example 2 | Comparative Example 3 | Comparative Example 4 | Inventive Example 1 | Inventive Example 2 | Inventive Example 3 | Inventive Example 4 |
|---|---|---|---|---|---|---|---|---|
| Base Stock - Group 1 | 79.3 | | | | | | | |
| Base Stock - Group 1 | 16.3 | | | | | | | |
| Base Stock - Group 3 | | 85.6 | 85.4 | 85.6 | 85.4 | 86 | 84.2 | 82 |
| Base Stock - Group 4 | | 9.9 | 9.9 | 9.9 | 9.9 | 9.9 | 10.1 | 10.1 |
| Molybdenum Dithiocarbamate | | | 0.1 | | 0.1 | 0.1 | 1 | 2 |
| Zinc Dithiocarbamate | | | | 0.6 | 0.6 | 0.1 | 1 | 2 |
| Calcium Alkyl Salicylate Detergent | | | | | | | | |
| ZDDP | 0.6 | 0.6 | 0.6 | | | | | |
| Rest of formulation | 3.8 | 3.9 | 4 | 3.9 | 4 | 3.9 | 3.7 | 3.9 |
| Total | 100 | 100 | 100 | 100 | 100 | 100 | 100 | 100 |
| | | | | | | | | |
| D2896, TBN | 8.8 | 8.8 | 8.8 | 9 | 9 | 8.8 | 8.8 | 8.9 |
| KV100 | 10.8 | 10.3 | 10.3 | 10.6 | 10.3 | 10.6 | 10.3 | 10.3 |
| MTM Boundary Traction Coefficient (9 mm/s rolling speed) | 0.1018 | 0.0926 | 0.0882 | 0.0749 | 0.0620 | 0.0607 | 0.0611 | 0.0597 |
| MTM Mixed Traction Coefficient (96 mm/s rolling speed) | 0.0608 | 0.0449 | 0.0387 | 0.0384 | 0.0347 | 0.0319 | 0.0335 | 0.0332 |
| MTM Hydrodynamic Traction Coefficient (880 mm/s rolling speed) | 0.0391 | 0.0208 | 0.0215 | 0.0204 | 0.0207 | 0.0205 | 0.0210 | 0.0213 |

Figure 3

| Name | Comparative Example 5 | Inventive Example 5 | Inventive Example 6 | Inventive Example 7 |
|---|---|---|---|---|
| Base Stock - Group 1 | 92.5 | | | |
| Base Stock - Group 1 - KV100 5.2 cSt | 3.1 | | | |
| Base Stock - Group 3- KV100 7.7 cSt | | 65 | 75.71 | 92.3 |
| Base Stock - Group 1 - KV100 31.8 cSt | | 31.5 | | |
| Base Stock - Group 4 - KV100 157.4 cSt | | | 20.9 | |
| Basestock - Group 5 - PMA - KV100 >200 cSt | | | | 4.26 |
| Molybdenum Dithiocarbamate | | 0.1 | 0.1 | 0.1 |
| Zinc Dithiocarbamate | | 0.6 | 0.6 | 0.6 |
| Calcium Alkyl Salicylate Detergent | | 2.32 | 2.3 | 2.3 |
| ZDDP | 0.6 | | | |
| Rest of formulation | 3.8 | 0.48 | 0.39 | 0.44 |
| Total | 100 | 100 | 100 | 100 |
| | | | | |
| D2896, TBN | 8.7 | 8.8 | 8.7 | 8.7 |
| KV100 | 12.2 | 12.7 | 13.2 | 12.7 |
| MTM Boundary Traction Coefficient (9 mm/s rolling speed) | 0.0794 | 0.0479 | 0.0549 | 0.0324 |
| MTM Mixed Traction Coefficient (96 mm/s rolling speed) | 0.0493 | 0.0338 | 0.0322 | 0.0251 |
| MTM Hydrodynamic Traction Coefficient (880 mm/s rolling speed) | 0.04 | 0.0266 | 0.0213 | 0.0209 |

Figure 4

| Name | Comparative Example 6 | Inventive Example 8 | Inventive Example 9 | Inventive Example 10 | Inventive Example 11 | Comparative Example 7 | Inventive Example 12 | Inventive Example 13 | Inventive Example 14 |
|---|---|---|---|---|---|---|---|---|---|
| Base Stock - Group 1 - KV100 12.1 cSt | 93.22 | | | | | 45.71 | | | |
| Base Stock - Group 1 - KV100 5.2 cSt | 3.18 | | | | | 49.86 | | | |
| Base Stock - Group 3 - KV100 7.7 cSt | | 63.53 | 89.05 | 87.67 | 80.38 | | 94.16 | 94.46 | 96.05 |
| Basestock - Group 5 - PMA - KV100 >200 cSt | | | | 9.08 | | | | | 0.7 |
| Base Stock - Group 4 - KV100 157.4 cSt | | | | | 16.37 | | | | |
| Base Stock - Group 1 - KV100 31.8 cSt | | 33.24 | | | | | 2.57 | | |
| Basestock - Group 5 - PIB - KV100 >200cSt | | | 7.71 | | | | | 2.29 | |
| Molybdenum Dithiocarbamate | | 0.1 | 0.1 | 0.1 | 0.1 | | 0.1 | 0.1 | 0.1 |
| Zinc Dithiocarbamate | | 0.6 | 0.6 | 0.6 | 0.6 | | 0.6 | 0.6 | 0.6 |
| Calcium Alkyl Salicylate Detergent | | 2.26 | 2.24 | 2.24 | 2.26 | | 2.27 | 2.24 | 2.24 |
| ZDDP | 0.4 | | | | | 0.4 | | | |
| Rest of formulation | 3.2 | 0.27 | 0.30 | 0.31 | 0.29 | 4.03 | 0.30 | 0.31 | 0.31 |
| Total | 100 | 100 | 100 | 100 | 100 | 100 | 100 | 100 | 100 |
| | | | | | | | | | |
| D2896, TBN | 8.6 | 8.6 | 8.5 | 8.5 | 8.5 | 8.6 | 8.6 | 8.5 | 8.5 |
| KV100, cSt | 12.69 | 12.99 | 12.88 | 12.41 | 13.29 | 8.52 | 8.41 | 9.31 | 8.37 |
| MTM Boundary Traction Coefficient (9 mm/s rolling speed) | 0.0725 | 0.0558 | 0.0364 | 0.0413 | 0.0184 | 0.1036 | 0.0473 | 0.037 | 0.0254 |
| MTM Mixed Traction Coefficient (96 mm/s rolling speed) | 0.0469 | 0.0407 | 0.0286 | 0.0270 | 0.0209 | 0.0612 | 0.0320 | 0.0317 | 0.0260 |
| MTM Hydrodynamic Traction Coefficient (880 mm/s rolling speed) | 0.0382 | 0.0271 | 0.0231 | 0.0199 | 0.0203 | 0.0377 | 0.0210 | 0.0232 | 0.0211 |

Figure 5

| Name | Comparative Example 8 | Inventive Example 15 | Inventive Example 16 | Inventive Example 17 |
|---|---|---|---|---|
| Base Stock - Group 1 - KV100 12.1 cSt | 76.3 | | | |
| Base Stock - Group 1 - KV100 5.2 cSt | 4.7 | | | |
| Base Stock - Group 3- KV100 7.7 cSt | | 35.8 | 66.9 | 85.97 |
| Base Stock - Group 1- KV100 31.8 cSt | | 51.5 | | |
| Base Stock - Group 4 - KV100 157.4 cSt | | | 20.5 | |
| Basestock - Group 5 - PMA - KV100 >200 cSt | | | | 1.5 |
| Molybdenum Dithiocarbamate | | 0.1 | 0.1 | 0.1 |
| Zinc Dithiocarbamate | | 0.6 | 0.6 | 0.6 |
| Calcium Alkyl Salicylate Detergent | | 11.50 | 11.50 | 11.50 |
| ZDDP | 0.45 | | | |
| Rest of formulation | 18.55 | 0.5 | 0.5 | 0.33 |
| Total | 100 | 100 | 100 | 100 |
| | | | | |
| D2896, TBN | 42 | 41 | 41 | 41 |
| KV100 | 16.9 | 17.44 | 18 | 15.9 |
| MTM Boundary Traction Coefficient (9 mm/s rolling speed) | 0.0695 | 0.0422 | 0.0348 | 0.0248 |
| MTM Mixed Traction Coefficient (96 mm/s rolling speed) | 0.0455 | 0.0351 | 0.0260 | 0.0276 |
| MTM Hydrodynamic Traction Coefficient (880 mm/s rolling speed) | 0.0384 | 0.0328 | 0.0217 | 0.0224 |

Figure 6

| Name | Comparative Example 9 | Inventive Example 18 | Inventive Example 19 | Inventive Example 20 |
|---|---|---|---|---|
| Base Stock - Group 1 - KV100 12.1 cSt | 79.6 | | | |
| Base Stock - Group 3- KV100 7.7 cSt | | 37.3 | 58.9 | 84.6 |
| Base Stock - Group 1- KV100 31.8 cSt | | 51.56 | | |
| Base Stock - Group 4 - KV100 157.4 cSt | | | 29.9 | |
| Basestock - Group 5 - PMA - KV100 >200 cSt | | | | 4.3 |
| Molybdenum Dithiocarbamate | | 0.1 | 0.1 | 0.1 |
| Zinc Dithiocarbamate | | 0.6 | 0.6 | 0.6 |
| Calcium Alkyl Salicylate Detergent | | 10 | 10 | 10 |
| ZDDP | 0.2 | | | |
| Rest of formulation | 20.2 | 0.44 | 0.5 | 0.4 |
| Total | 100 | 100 | 100 | 100 |
| | | | | |
| D2896, TBN | 35 | 35 | 35 | 35 |
| KV100 | 20.5 | 20.5 | 22.1 | 19.6 |
| MTM Boundary Traction Coefficient (9 mm/s rolling speed) | 0.0639 | 0.0459 | 0.0331 | 0.0247 |
| MTM Mixed Traction Coefficient (96 mm/s rolling speed) | 0.0450 | 0.0375 | 0.0269 | 0.0241 |
| MTM Hydrodynamic Traction Coefficient (880 mm/s rolling speed) | 0.0419 | 0.0335 | 0.0238 | 0.0207 |

Figure 7

| Name | Comparative Example 10 | Inventive Example 21 | Inventive Example 22 | Inventive Example 23 | Inventive Example 24 |
|---|---|---|---|---|---|
| Base Stock - Group 1 - KV100 12.1 cSt | 47.6 | | | | |
| Base Stock - Group 3- KV100 7.7 cSt | | 25.96 | 74.1 | 76.26 | 58.75 |
| Base Stock - Group 1- KV100 31.8 cSt | 41.1 | 66.1 | | | |
| Basestock - Group 5 - PMA - KV100 >200 cSt | | | 17.9 | | |
| Basestock - Group 5 - PIB - KV100 >200cSt | | | | 15.69 | |
| Base Stock - Group 4 - KV100 157.4 cSt | | | | | 33.28 |
| Molybdenum Dithiocarbamate | | 0.1 | 0.1 | 0.1 | 0.1 |
| Zinc Dithiocarbamate | | 0.6 | 0.6 | 0.6 | 0.6 |
| Calcium Alkyl Salicylate Detergent | | 7 | 7 | 7 | 7 |
| Rest of formulation | 11.3 | 0.24 | 0.3 | 0.35 | 0.27 |
| Total | 100 | 100 | 100 | 100 | 100 |
| | | | | | |
| D2896, TBN | 25 | 25 | 25 | 25 | 25 |
| KV100, cSt | 20.1 | 19.9 | 20.1 | 19.2 | 20.2 |
| MTM Boundary Traction Coefficient (9 mm/s rolling speed) | 0.0624 | 0.0481 | 0.0364 | 0.0237 | 0.0411 |
| MTM Mixed Traction Coefficient (96 mm/s rolling speed) | 0.0465 | 0.0388 | 0.0256 | 0.0252 | 0.0241 |
| MTM Hydrodynamic Traction Coefficient (880 mm/s rolling speed) | 0.0424 | 0.0371 | 0.0217 | 0.0263 | 0.0220 |

Figure 8

| Name | Comparative Example 11 | Inventive Example 25 | Inventive Example 26 | Inventive Example 27 | Inventive Example 28 | Inventive Example 29 |
|---|---|---|---|---|---|---|
| Base Stock - Group 1 - KV100 12.1 cSt | 70.1 | | | | | |
| Base Stock - Group 3- KV100 7.7 cSt | | 65.9 | 67.8 | 69 | 65.9 | 69 |
| Base Stock - Group 1- KV100 31.8 cSt | | 13 | | | | |
| Base Stock - Group 4 - KV100 157.4 cSt | | | 11 | 13 | | |
| Basestock - Group 5 - PMA - >200 cSt | | | | | 13.1 | 13 |
| Molybdenum Dithiocarbamate | | 0.1 | 0.1 | 0.1 | 0.1 | 0.1 |
| Zinc Dithiocarbamate | | 0.6 | 0.6 | 0.6 | 0.6 | 0.6 |
| Calcium Alkyl Salicylate Detergent | | 20 | 20 | | 20 | |
| Rest of formulation | 29.9 | 0.4 | 0.5 | 17.3 | 0.3 | 17.3 |
| Total | 100 | 100 | 100 | 100 | 100 | 100 |
| | | | | | | |
| D2896, TBN | 70 | 70 | 70 | 70 | 70 | 70 |
| Kv100 | 21 | 18 | 16 | 18 | 23 | 22 |
| MTM Boundary Traction Coefficient (9 mm/s rolling speed) | 0.0696 | 0.0501 | 0.0553 | 0.0568 | 0.0309 | 0.0605 |
| MTM Mixed Traction Coefficient (96 mm/s rolling speed) | 0.0507 | 0.0320 | 0.0341 | 0.0434 | 0.0255 | 0.0339 |
| MTM Hydrodynamic Traction Coefficient (880 mm/s rolling speed) | 0.0478 | 0.0247 | 0.0228 | 0.0246 | 0.0220 | 0.0215 |

Figure 9

| Name | Comparative Example 12 | Comparative Example 13 | Inventive Example 30 |
|---|---|---|---|
| Base Stock - Group 1 - KV100 12.1 cSt | 65.31 | 51.71 | |
| Base Stock - Group 1- KV100 31.8 cSt | | 19 | |
| Base Stock - Group 3- KV100 7.7 cSt | | | 66.9 |
| Basestock - Group 5 - PIB - KV100 >200cSt | 2.81 | | |
| Basestock - Group 5 - PMA - KV100 >200 cSt | | | 4.09 |
| Molybdenum Dithiocarbamate | | | 0.1 |
| Zinc Dithiocarbamate | | | 0.6 |
| Calcium Alkyl Salicylate Detergent | | | 28 |
| Rest of formulation | 31.88 | 29.29 | 0.31 |
| Total | 100 | 100 | 100 |
| | | | |
| D2896, TBN | 101 | 100 | 103 |
| KV100, cSt | 21.74 | 20.1 | 22.23 |
| MTM Boundary Traction Coefficient (9 mm/s rolling speed) | 0.0742 | 0.0628 | 0.0301 |
| MTM Mixed Traction Coefficient (96 mm/s rolling speed) | 0.0486 | 0.0463 | 0.0294 |
| MTM Hydrodynamic Traction Coefficient (880 mm/s rolling speed) | 0.0462 | 0.0447 | 0.0228 |

Figure 14

| Name | Comparative Example 13 | Inventive Example 30 |
|---|---|---|
| **Brake Specific Fuel Consumption [g/kWh]** | 233.4 ±0.1 | 232.1±0.3 |
| **Percent fuel economy benefit compared to reference** | 0% | 0.5% |

90% confidence intervals (Tukey)

Figure 15

| Modes* | Speed (rpm) | % Load |
|---|---|---|
| **1** | 900 | 100 |
| **2** | 900 | 75 |
| **3** | 900 | 50 |
| **4** | 900 | 25 |

Test Run Order = 4, 3, 2, 1

*Based on Cycle E2 Table 6 of ISO 8178-4:2007

Figure 16

| FE Testing Cycle Parameters | Mode 1 | Mode 2 | Mode 3 | Mode 4 |
|---|---|---|---|---|
| Time (min) - 1st set | 20 | 20 | 20 | 20 |
| Time (min) - 2nd set | 20 | 20 | 20 | 20 |
| Time (min) - 3rd set | 20 | 20 | 20 | 20 |
| Time (min) - 4th set | 20 | 20 | 20 | 20 |
| Time (min) - 5th set | 20 | 20 | 20 | 20 |
| Speed (rpm) | 900 | 900 | 900 | 900 |
| Coolant temperature (°C) | kept constant – measured during test | | | |
| Fuel temperature (°C) | kept constant – measured during test | | | |
| Inlet Air temperature (°C) | kept constant – measured during test | | | |
| Oil temperature (°C) | kept constant – measured during test | | | |
| Charge air temperature (°C) | kept constant – measured during test | | | |

1. Modes as defined in Figure 15

Figure 17

| Engine Parameter | Commercial Engines | Single Cylinder Test Engine |
|---|---|---|
| Bore Size (mm) | 260-980 | 108 |
| Stoke/Bore (ratio) | ~ 2.5 – 4.4 | 4.0 |
| RPM | ~ 60 – 250 | 300 – 600 |
| Engine Output (hp/cylinder) | 7500 + | 100 |
| BMEP (bar) | 18 – 21 | 20 |
| Pressure max (bar) | 150 + | 150 |
| Load (%) | 100 – 15 | 100 – 25 |
| Marine Cylinder Lubricant Feed Rate (grams/kilowatt hour) | 1.4 – 0.6 | 1.6 – 0.3 |

Figure 18

| Modes | Speed (rpm) | % Load | Power (kw) | BMEP (bar) as Reference |
|---|---|---|---|---|
| **1** | 280 | 30 | 7.2 | 3.9 |
| **2** | 280 | 70 | 16.8 | 9.1 |
| **3** | 410 | 30 | 14.9 | 5.5 |
| **4** | 410 | 70 | 34.7 | 12.8 |
| **5** | 545 | 30 | 21.8 | 6 |
| **6** | 545 | 70 | 50.8 | 14.1 |

Figure 19

| FE Testing Cycle Parameters | Mode 1 | Mode 3 | Mode 2 | Mode 5 | Mode 4 | Mode 6 |
|---|---|---|---|---|---|---|
| Time (min) - 1st set | 50 | 50 | 50 | 50 | 50 | 50 |
| Time (min) - 2nd set | 50 | 50 | 50 | 50 | 50 | 50 |
| Time (min) - 3rd set | 50 | 50 | 50 | 50 | 50 | 50 |
| Time (min) - 4th set | 50 | 50 | 50 | 50 | 50 | 50 |
| Time (min) - 5th set | 50 | 50 | 50 | 50 | 50 | 50 |
| Power (kW) | 7.2 | 14.9 | 16.8 | 21.8 | 34.7 | 50.8 |
| Speed (rpm) | 280 | 410 | 280 | 545 | 410 | 545 |
| Torque (Nm) | 245.3 | 346.3 | 572.4 | 381.4 | 808 | 890 |
| BMEP (bar) - as reference | 3.9 | 5.5 | 9.1 | 6 | 12.8 | 14.1 |
| Lube Feed Rate, g/kWh | kept constant during the test | | | | | |
| Coolant temperature (°C) | kept constant – measured during test | | | | | |
| Fuel temperature (°C) | kept constant – measured during test | | | | | |
| Inlet Air temperature (°C) | kept constant – measured during test | | | | | |
| Oil temperature (°C) | kept constant – measured during test | | | | | |
| Charge air temperature (°C) | kept constant – measured during test | | | | | |

1. After a 30 minute warm up each oil is run for 5 loops. The first loop data is excluded from data analysis and the last sixty seconds of each mode of the remaining four loops is recorded for data analysis.
2. Modes as defined in figure 18

MARINE LUBRICATING OILS AND METHOD OF MAKING AND USE THEREOF

CROSS-REFERENCE TO RELATED APPLICATIONS

This application claims priority to U.S. Provisional Application Ser. No. 62/523,406 filed Jun. 22, 2017, which is herein incorporated by reference in its entirety.

FIELD

The present disclosure relates to lubricating oil formulations for the lubrication of marine diesel engines and methods of making and using such formulations.

BACKGROUND

Diesel engines designed for marine and stationary power applications can be either 2-stroke or 4-stroke cycle having up to 20 cylinders and are typically classified as low-speed, medium-speed or high-speed diesel engines. These engines burn a wide variety of fuels ranging from residual or heavy fuel oils to natural gas (diesel compression or spark-ignited) and are most commonly used for marine propulsion, marine auxiliary (vessel electricity generation), distributed power generation and combined heating and power (CHP). Lubrication of such engines can be all-loss (i.e., lubricant fed directly to the cylinder by cylinder oil) or recirculation involving oil sumps. Lubrication of critical engine parts includes piston rings, cylinder liners, bearings, piston cooling, fuel pump, engine control hydraulics, etc. Fuel is typically the major cost of operating these engines and a typical 12 cylinder, 90 cm bore low-speed diesel engine used in marine vessel container service will burn up to approximately $7M of heavy fuel oil or $14M of marine diesel fuel per year. Therefore, a fuel efficiency gain of as little as 1% would result in approximately $130K to $200K in annual savings to the ship operator. In addition, governmental organizations, such as the International Marine Organization, U.S. Environmental Protection Agency and the California Air Resources Board are legislating emissions requirements for these engines. Improving fuel efficiency will not only reduce operating cost, but will also reduce emissions ($CO_2$, $SO_x$, $NO_x$ and Particulate Matter) commensurately which should result in some emissions credit trading value.

In addition to providing adequate oil film thickness to prevent metal-to-metal contact, lubricants for these engines are designed to cope with a variety of other stresses, including neutralizing acids formed by the combustion of fuels containing sulfur to minimize corrosive wear of the piston rings and cylinder liner, minimizing engine deposits formed by fuel combustion and by contamination of the lubricant with raw or partially burned fuel, resisting thermal/oxidation degradation of the lubricant due to the extreme heat in these engines, transferring heat away from the engine, etc.

A long term requirement is that the lubricant must maintain cleanliness within the high temperature environment of the engine, especially for critical components such as the piston and piston rings. Contamination of the engine oil in the engine by the accumulation in it of raw and partially burned fuel combustion products, water, soot as well as the thermal/oxidation degradation of the oil itself can degrade the engine cleanliness performance of the engine oil. Therefore, it is desirable for engine oils to be formulated to have good cleanliness qualities and to resist degradation of those qualities due to contamination and thermal/oxidative degradation.

There is a need for an improved marine diesel oil formulation and methods of making and using such formulations for improving fuel efficiency and reducing emissions of marine diesel engines in combination with the other desired attributes described above.

SUMMARY

The present disclosure is directed to marine lubricating oil compositions and methods of making and using such marine lubricating oil compositions. The marine lubricating oils of the instant disclosure utilize a bimodal base stock blend including a low viscosity Group III base stock and a high viscosity co-base stock in combination with a friction modifier and anti-wear additive. The cobase stock is selected from the group consisting of a Group I, a Group IV, a Group V and combinations thereof.

More particularly, the present disclosure is directed to a marine lubricating oil comprising from 15 to 95 wt % of a Group III base stock having a KV100 of 4 to 12 cSt, 0.5 to 55 wt % of cobase stock having a KV100 of 29 to 1000 cSt, 0.1 to 2.0 wt % of a molydithiocarbamate friction modifier, 0.1 to 2.0 wt % of a zinc dithiocarbamate anti-wear additive, and 2 to 30 wt % of other lubricating oil additives. The cobase stock is selected from the group consisting of a Group I, a Group IV, a Group V and combinations thereof.

The present disclosure is also directed to a method of making a marine lubricating oil comprising the steps of: providing a Group III base stock having a KV100 of 4 to 12 cSt, a cobase stock having a KV100 of 29 to 1000 cSt selected from the group consisting of a Group I, a Group IV, a Group V and combinations thereof, a molydithiocarbamate friction modifier, a zinc dithiocarbamate anti-wear additive, and other lubricating oil additives, and blending from 15 to 95 wt % of the Group III base stock, 0.5 to 55 wt % of the cobase stock, 0.1 to 2.0 wt % of the molydithiocarbamate friction modifier, 0.1 to 2.0 wt % of the zinc dithiocarbamate anti-wear additive, and 2 to 30 wt % of the other lubricating oil additives to form the marine lubricating oil.

The present disclosure is also directed to a method of improving fuel efficiency in marine diesel engines comprising the steps of: providing a marine lubricating oil to a marine diesel engine, wherein the marine lubricating oil comprises from 15 to 95 wt % of a Group III base stock having a KV100 of 4 to 12 cSt, 0.5 to 55 wt % of cobase stock having a KV100 of 29 to 1000 cSt, 0.1 to 2.0 wt % of a molydithiocarbamate friction modifier, 0.1 to 2.0 wt % of a zinc dithiocarbamate anti-wear additive, and 2 to 30 wt % of other lubricating oil additives, and wherein the cobase stock is selected from the group consisting of a Group I, a Group IV, a Group V and combinations thereof, and wherein the MTM traction coefficient of the marine lubricating oil is lower than a marine lubricating oil including a Group I base stock which is substantially free of a cobase stock, substantially free of a molydithiocarbamate friction modifier, or substantially free of a zinc dithiocarbamate antiwear additive.

These and other features and attributes of the disclosed marine lubricating oils and methods of making and reducing friction and improving fuel efficiency of marine lubricating oils of the present disclosure and their advantageous applications and/or uses will be apparent from the detailed description which follows, particularly when read in conjunction with the figures appended hereto.

BRIED DESCRIPTION OF THE DRAWINGS

To assist those of ordinary skill in the relevant art in making and using the subject matter hereof, reference is made to the appended drawings, wherein:

FIG. 1 is a graphical representation of mini traction machine (MTM) traction coefficient versus rolling speed illustrating the contribution of each element of the inventive marine lubricating oil composition to reduced friction and in comparison to comparative marine lubricating oils including ZDDP.

FIG. 2 presents inventive and comparative marine lubricating oil formulations with different contents of Mo and ZDTC.

FIG. 3 presents inventive and comparative marine lubricating oil formulations for marine system oils of low base number and SAE 30 grades.

FIG. 4 presents inventive and comparative marine lubricating oil formulations for marine system oils of low base number and SAE 20 and 30 grades.

FIG. 5 presents inventive and comparative marine lubricating oil formulations for marine trunk piston engine oils of medium base number and SAE 40 grades.

FIG. 6 presents inventive and comparative marine lubricating oil formulations for marine cylinder oils of medium base number and SAE 50 grades.

FIG. 7 presents additional inventive and comparative marine lubricating oil formulations for marine cylinder oils of medium base number and SAE 50 grades.

FIG. 8 presents yet additional inventive and comparative marine lubricating oil formulations for marine cylinder oils of high base number and SAE 50 grades.

FIG. 9 presents still yet additional inventive and comparative marine lubricating oil formulations for marine cylinder oils of high base number and SAE 50 grades.

FIG. 14 is a tabular representation of the brake specific fuel consumption of an inventive and comparative marine cylinder oil run used in a Bolnes 3DNL 190/600 two-stroke marine diesel crosshead engine.

FIG. 15 is a tabular representation of the brake specific fuel consumption as measured in grams per kilowatt hour while running the engine in four different modes.

FIG. 16 is a tabular representation of the FE testing cycle parameters for the four different modes of testing.

FIG. 17 is a tabular representation of the engine design parameters for commercial engines and a single cylinder test engine.

FIG. 18 is a tabular representation of the brake specific fuel consumption as measured in grams per kilowatt hour while running the engine in six different modes.

FIG. 19 is a tabular representation of FEC testing cycle parameters for 6 different modes in accordance with increasing power, while keeping various engine parameters constant.

DETAILED DESCRIPTION

Figure 1:
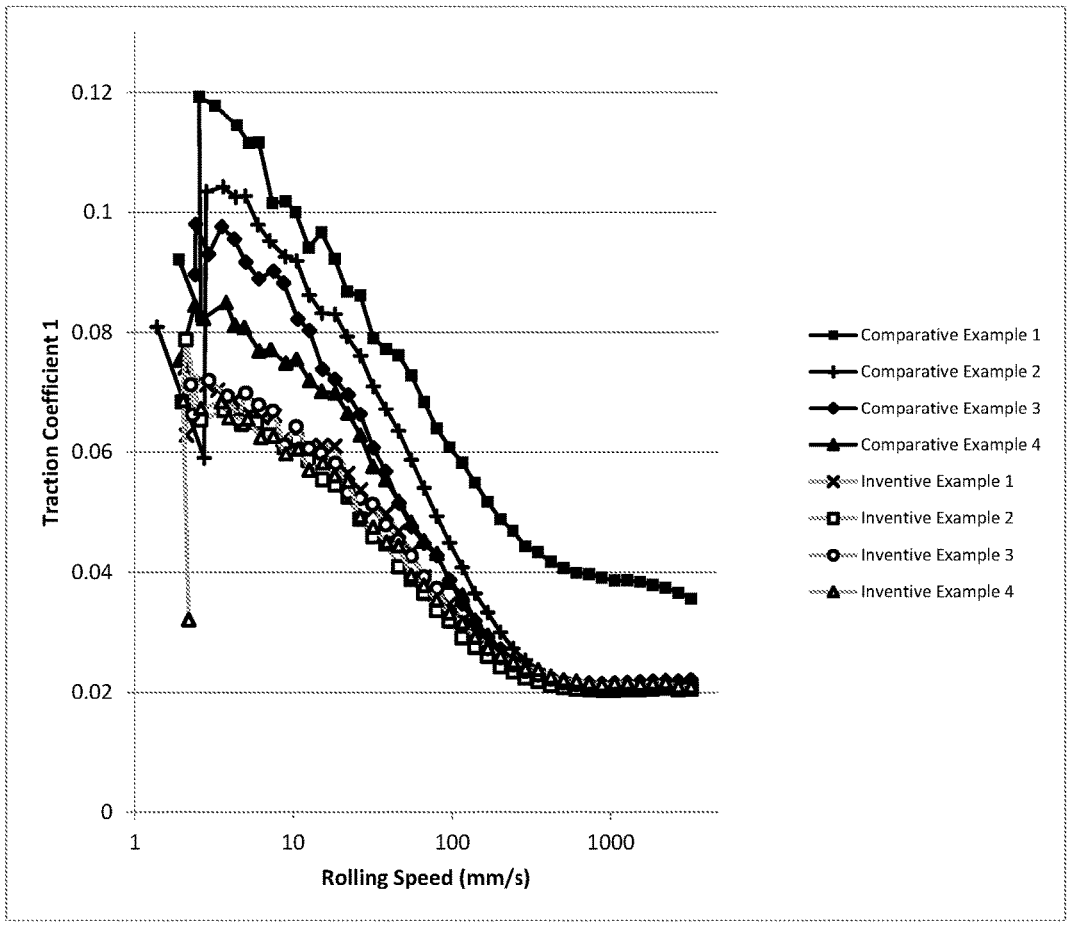

The following is a detailed description of the disclosure provided to aid those skilled in the art in practicing the present disclosure. Those of ordinary skill in the art may make modifications and variations in the embodiments described herein without departing from the spirit or scope of the present disclosure. Unless otherwise defined, all technical and scientific terms used herein have the same meaning as commonly understood by one of ordinary skill in the art to which this disclosure belongs. The terminology used in the description of the disclosure herein is for describing particular embodiments only and is not intended to be limiting of the disclosure. All publications, patent applications, patents, figures and other references mentioned herein are expressly incorporated by reference in their entirety.

Where a range of values is provided, it is understood that each intervening value, to the tenth of the unit of the lower limit unless the context clearly dictates otherwise (such as in the case of a group containing a number of carbon atoms in which case each carbon atom number falling within the range is provided), between the upper and lower limit of that range and any other stated or intervening value in that stated range is encompassed within the disclosure. The upper and lower limits of these smaller ranges may independently be included in the smaller ranges is also encompassed within the disclosure, subject to any specifically excluded limit in the stated range. Where the stated range includes one or both of the limits, ranges excluding either both of those included limits are also included in the disclosure.

It should also be understood that, unless clearly indicated to the contrary, in any methods claimed herein that include more than one step or act, the order of the steps or acts of the method is not necessarily limited to the order in which the steps or acts of the method are recited.

The following terms are used to describe the present disclosure. In instances where a term is not specifically defined herein, that term is given an art-recognized meaning by those of ordinary skill applying that term in context to its use in describing the present disclosure.

The articles "a" and "an" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising"

can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

The term "about" or "approximately" means an acceptable experimental error for a particular value as determined by one of ordinary skill in the art, which depends in part on how the value is measured or determined. All numerical values within the specification and the claims herein are modified by "about" or "approximately" the indicated value, and take into account experimental error and variations that would be expected by a person having ordinary skill in the art.

The phrase "major amount" or "major component" as it relates to components included within the marine lubricating oils of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the lubricating oil. The phrase "minor amount" or "minor component" as it relates to components included within the marine lubricating oils of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the lubricating oil. The phrase "substantially free" or "essentially free" as it relates to components included within the marine lubricating oils of the specification and the claims means that the particular component is at 0 weight % within the lubricating oil, or alternatively is at impurity type levels within the lubricating oil (less than 100 ppm, or less than 20 ppm, or less than 10 ppm, or less than 1 ppm). The phrase "other lubricating oil additives" as used in the specification and the claims means other lubricating oil additives that are not specifically recited in the particular section of the specification or the claims. For example, other lubricating oil additives may include, but are not limited to, an anti-wear additive, antioxidant, detergents, dispersant, pour point depressant, corrosion inhibitor, metal deactivator, seal compatibility additive, anti-foam agent, inhibitor, anti-rust additive, friction modifier and combinations thereof.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the 10 United States Patent Office Manual of Patent Examining Procedures, Section 2111.03.

As used herein in the specification and in the claims, the phrase "at least one," in reference to a list of one or more elements, should be understood to mean at least one element selected from anyone or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

As used herein in the specification and claims, KV100 stands for kinematic viscosity at 100 deg. C. as measured by ASTM D445. D2896, TBN in the specification and the figures stands for the total base number in mg of potassium hydroxide per gram of oil sample as measured by ASTM D2896.

Marine Lubricating Oil Formulations

The present disclosure is directed to marine lubricating oil compositions. The present disclosure is also directed to methods making such marine lubricating oils and methods for reducing the friction or traction coefficient as measured by the mini traction machine (MTM) method and improving the fuel efficiency of marine lubricating oil compositions. The marine lubricating oils described herein provide for fuel-efficient cylinder oils, fuel-efficient system oils and fuel-efficient trunk piston engine oils. The marine lubricating oils disclosed herein include a combination of a bimodal base stock blend and a combination of a friction modifier additive and an anti-wear additive with optionally other lubricating oil additives that may provide for an improvement in MTM traction coefficient over a range of rolling speeds, which may translate into improvements in fuel efficiency. The inventive marine lubricating oils disclosed herein may be formulated across a broad range of viscosity grades and base numbers.

The marine lubricating oils of the instant disclosure utilize a bimodal base stock blend including a combination of a low viscosity Group III base stock and a high viscosity co-base stock with a friction modifier and anti-wear additive. The cobase stock is selected from the group consisting of a Group I, a Group IV, a Group V and combinations thereof.

In one form of the present disclosure, provided is a marine lubricating oil including from 15 to 95 wt % of a Group III base stock having a KV100 of 4 to 12 cSt, 0.5 to 55 wt % of cobase stock having a KV100 of 29 to 1000 cSt, 0.1 to 2.0 wt % of a molydithiocarbamate friction modifier, 0.1 to 2.0 wt % of a zinc dithiocarbamate anti-wear additive, and 2 to 30 wt % of other lubricating oil additives. The cobase stock is selected from the group consisting of a Group I, a Group IV, a Group V and combinations thereof.

In another form of the present disclosure, provided is a method of making a marine lubricating oil comprising the steps of: providing a Group III base stock having a KV100 of 4 to 12 cSt, a cobase stock having a KV100 of 29 to 1000 cSt selected from the group consisting of a Group I, a Group IV, a Group V and combinations thereof, a molydithiocarbamate friction modifier, a zinc dithiocarbamate anti-wear additive, and other lubricating oil additives, and blending from 15 to 95 wt % of the Group III base stock, 0.5 to 55 wt % of the cobase stock, 0.1 to 2.0 wt % of the molydithiocarbamate friction modifier, 0.1 to 2.0 wt % of the zinc dithiocarbamate anti-wear additive, and 2 to 30 wt % of the other lubricating oil additives to form the marine lubricating oil.

In still yet another form of the present disclosure, provided is a method of improving fuel efficiency in marine diesel engines comprising the steps of: providing a marine lubricating oil to a marine diesel engine, wherein the marine lubricating oil comprises from 15 to 95 wt % of a Group III base stock having a KV100 of 4 to 12 cSt, 0.5 to 55 wt % of cobase stock having a KV100 of 29 to 1000 cSt, 0.1 to 2.0 wt % of a molydithiocarbamate friction modifier, 0.1 to 2.0 wt % of a zinc dithiocarbamate anti-wear additive, and 2 to 30 wt % of other lubricating oil additives, and wherein the cobase stock is selected from the group consisting of a Group I, a Group IV, a Group V and combinations thereof, and wherein the MTM traction coefficient of the marine lubricating oil is lower than a marine lubricating oil including a Group I base stock which is substantially free of a cobase stock, substantially free of a molydithiocarbamate friction modifier, or substantially free of a zinc dithiocarbamate antiwear additive.

The inventive marine lubricating oils, methods of making and methods of using such marine lubricating oils may have a kinematic viscosity at 100 deg. C. (KV100) ranging from 5 to 30, or 7 to 30, or 10 to 25, or 12 to 22, or 15 to 20 cSt. The marine lubricating oils may also have a total base number (TBN) ranging from 8 to 100, or 10 to 90, or 20 to 80, or 30 to 70, or 40 to 60, or 45 to 55.

The inventive marine lubricating oils, methods of making and methods of using such marine lubricating oils include from 15 to 95 wt %, or 20 to 90 wt %, or 25 to 85 wt %, or 30 to 80 wt %, or 35 to 75 wt %, or 40 to 70 wt %, or 45 to 65 wt %, or 50 to 60 wt % of a low viscosity Group III base stock. One advantageous Group III base stock is GTL. The Group III base stock may have a kinematic viscosity at 100 deg. C. (KV100) ranging from 4 to 12, or 5 to 11, or 6 to 10, or 7 to 9 cSt.

The inventive marine lubricating oils, methods of making and methods of using such marine lubricating oils include from 0.5 to 55 wt %, or 1 to 50 wt %, or 5 to 45 wt %, or 10 to 40 wt %, or 15 to 35 wt %, or 20 to 30 wt % of a high viscosity cobase stock. The cobase stock may have a kinematic viscosity at 100 deg. C. (KV100) ranging from 29 to 1000, or 40 to 800, or 60 to 600, or 80 to 400, or 100 to 300, or 150 to 250 cSt. The cobase stock is selected from the group consisting of a Group I, a Group IV, a Group V and combinations thereof. One advantageous Group I cobase stock is bright stock. One advantageous Group IV cobase stock is a Friedel-Crafts catalyzed PAO base stock or a metallocene catalyzed PAO base stock. Advantageous Group V cobase stocks are selected from the group consisting of polyisobutylene, polymethacrylate and combinations thereof.

The inventive marine lubricating oils, methods of making and methods of using such marine lubricating oils include from 0.1 to 5 wt %, or 0.5 to 4.5 wt. %, or 1.0 to 4.0 wt %, or 1.5 to 3.5 wt %, or 2.0 to 3.0 wt % of a molydithiocarbamate friction modifier.

The inventive marine lubricating oils, methods of making and methods of using such marine lubricating oils include from 0.1 to 5 wt %, or 0.5 to 4.5 wt. %, or 1.0 to 4.0 wt %, or 1.5 to 3.5 wt %, or 2.0 to 3.0 wt % of a zinc dithiocarbamate anti-wear additive.

The inventive marine lubricating oils, methods of making and methods of using such marine lubricating oils also include from 2 to 30 wt %, or 5 to 25 wt %, or 8 to 22 wt %, or 10 to 20 wt %, or 12 to 18% of other lubricating oil additives. The other lubricating oil additives are selected from the group consisting of viscosity index improvers, antioxidants, detergents, dispersants, pour point depressants, corrosion inhibitors, metal deactivators, seal compatibility additives, anti-foam agents, inhibitors, anti-rust additives, other friction modifiers and other anti-wear additives.

In order to attain the total base number for the marine lubricating oils disclosed herein, one or more detergents are included in the lubricating oil. The one or more detergents are selected from alkali and/or alkaline earth metal salicylates, phenates, carboxylates, sulfonates, mixtures of phenates and salicylates or mixtures of phenates and carboxylates. The total treat level of the one or more detergents is in an amount of 6 to 30 wt %, or 8 to 28 wt %, or 10 to 26 wt %, or 12 to 24 wt %, or 14 to 22 wt %, or 16 to 20 wt. % of active ingredient of the oil.

The mini traction machine (MTM) boundary traction coefficient of the inventive marine lubricating oils are less than 0.07, or less than 0.06, or less than 0.05, or less than 0.04, or less than 0.03. The MTM boundary traction coefficient of the inventive marine lubricating oils are lower than a comparative marine lubricating oil including a Group I base stock which is substantially free of a cobase stock, substantially free of a molydithiocarbamate friction modifier, or substantially free of a zinc dithiocarbamate antiwear additive. In addition, the MTM mixed traction coefficient and the MTM hydrodynamic traction coefficient of the inventive marine lubricating oils are also less than 0.07, or less than 0.06, or less than 0.05, or less than 0.04, or less than 0.03. Moreover, the MTM mixed traction coefficient and the MTM hydrodynamic traction coefficient of the inventive marine lubricating oils are also lower than a comparative marine lubricating oil including a Group I base stock which is substantially free of a cobase stock, substantially free of a molydithiocarbamate friction modifier, or substantially free of a zinc dithiocarbamate antiwear additive.

The fuel efficiency (FE) improvement of the inventive marine lubricating oils are greater than 0.1%, or greater than 0.2%, or greater than 0.3%, or greater than 0.5%, or greater than 1.0%, or greater than 1.5%, or greater than 2.0%. The fuel efficiency (FE) of the inventive marine lubricating oils have a fuel efficiency greater than a comparative marine lubricating oil including a Group I base stock which is substantially free of a cobase stock, substantially free of a molydithiocarbamate friction modifier, or substantially free of a zinc dithiocarbamate antiwear additive. The fuel efficiency is calculated based upon the percentage improvement in brake specific fuel consumption of the inventive marine lubricating oils relative to the comparative marine lubricating oils.

The marine lubricating oil is useful in marine applications or uses including, but not limited to, a cylinder oil, a system oil or a trunk piston engine oil.

Base Stock or Base Oil

As employed herein and in the appended claims, the terms "base stock" and "base oil" are used synonymously and interchangeably. Cobase stock refers to a base stock in the formulation that is less in proportion of the total formulation than at least one other base stock in the formulation. The cobase stock is typically less than 50 wt % of the lubricating oil and is the high viscosity component of the bimodal blend of base stocks.

The lubricating oil base stock and cobase stock is any natural or synthetic lubricating base stock fraction typically having a kinematic viscosity at 100° C. of about 5 to 20 cSt ($mm^2/s$), more preferably about 7 to 16 cSt, ($mm^2/s$), most preferably about 9 to 13 cSt ($mm^2/s$). In a preferred embodiment, the use of the viscosity index improver permits the omission of oil of viscosity 20 cSt ($mm^2/s$) or more at 100° C. from the lube base oil fraction used to make the present formulation. Therefore, a preferred base oil is one which contains little, if any, heavy fractions; e.g., little, if any, lube oil fraction of viscosity 20 cSt ($mm^2/s$) or higher at 100° C.

The lubricating oil base stock and cobase stock can be derived from natural lubricating oils, synthetic lubricating oils or mixtures thereof. Suitable lubricating oil base stocks include base stocks obtained by isomerization of synthetic wax and slack wax, as well as hydrocrackate base stocks produced by hydrocracking (rather than solvent extracting) the aromatic and polar components of the crude. Suitable base stocks include those in API categories I, II and III, where saturates level and Viscosity Index are:

Group I—less than 90% and 80-120, respectively;

Group II—greater than 90% and 80-120, respectively; and

Group III—greater than 90% and greater than 120, respectively.

The base stock and cobase stock is an oil of lubricating viscosity and may be any oil suitable for the system lubrication of a cross-head engine. The lubricating oil may suitably be an animal, vegetable or a mineral oil. Suitably the lubricating oil is a petroleum-derived lubricating oil, such as naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example, liquid polyisobutene and polyalpha olefins. Commonly, a mineral oil is employed. The lubricating oil may generally comprise greater than 60, typically greater than 70% by mass of the lubricating oil composition and typically have a kinematic viscosity at 100° C. of from 2 to 40, for example, from 3 to 15 $mm^2/s$, and a viscosity index from 80 to 100, for example, from 90 to 95.

Another class of lubricating oil is hydrocracked oils, where the refining process further breaks down the middle and heavy distillate fractions in the presence of hydrogen at high temperatures and moderate pressures. Hydrocracked oils typically have kinematic viscosity at 100° C. of from 2 to 40, for example, from 3 to 15 $mm^2/s$, and a viscosity index typically in the range of from 100 to 110, for example, from 105 to 108.

Bright stock refers to base oils which are solvent-extracted, de-asphalted products from vacuum residuum generally having a kinematic viscosity at 100° C. from 28 to 36 $mm^2/s$, and are typically used in a proportion of less than 30, preferably less than 20, more preferably less than 15, most preferably less than 10, such as less than 5 mass %, based on the mass of the lubricating oil composition.

As discussed above, the base oil and cobase oil can be any animal, vegetable or mineral oil or synthetic oil. The base oil is used in a proportion of greater than 60 mass % of the composition. The oil typically has a viscosity at 100° C. of from 2 to 40, for example 3 to 15 $mm^2/s$ and a viscosity index of from 80 to 100. Hydrocracked oils can also be used which have viscosities of 2 to 40 $mm^2/s$ at 100° C. and viscosity indices of 100 to 110. Brightstock having a viscosity at 100° C. of from 28 to 36 $mm^2/s$ can also be used, typically in a proportion less than 30, preferably less than 20, most preferably less than 5 mass %.

Group II base stocks are classified by the American Petroleum Institute as oils containing greater than or equal to 90% saturates, less than or equal to 0.03 wt % sulfur and a viscosity index greater than or equal to 80 and less than 120.

Group III base stocks are classified by the American Petroleum Institute as oils containing greater than or equal to 90% saturates, less than or equal to 0.03% sulfur and a viscosity index of greater than or equal to 120. Group III base stocks are usually produced using a three-stage process involving hydrocracking an oil feed stock, such as vacuum gas oil, to remove impurities and to saturate all aromatics which might be present to produce highly paraffinic lube oil stock of very high viscosity index, subjecting the hydrocracked stock to selective catalytic hydrodewaxing which converts normal paraffins into branched paraffins by isomerization followed by hydrofinishing to remove any residual aromatics, sulfur, nitrogen or oxygenates.

Group III stocks also embrace non-conventional or unconventional base stocks and/or base oils which include one or a mixture of base stock(s) and/or base oil(s) derived from: (1) one or more Gas-to-Liquids (GTL) materials; as well as (2) hydrodewaxed, or hydroisomerized/cat (and/or solvent) dewaxed base stock(s) and/or base oil(s) derived from synthetic wax, natural wax or waxy feeds, waxy feeds including mineral and/or non-mineral oil waxy feed stocks such as gas oils, slack waxes (derived from the solvent dewaxing of natural oils, mineral oils or synthetic; e.g., Fischer-Tropsch feed stocks) and waxy stocks such as waxy fuels hydrocracker bottoms, waxy raffinate, hydrocrackate, thermal crackates, foots oil or other mineral, mineral oil, or even non-petroleum oil derived waxy materials such as waxy materials recovered from coal liquefaction or shale oil, linear or branched hydrocarbyl compounds with carbon number of about 20 or greater, preferably about 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (and/or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In a preferred embodiment, the GTL material, from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

Useful compositions of GTL base stock(s) and/or base oil(s), hydrodewaxed or hydroisomerized/cat (and/or solvent) dewaxed F-T material derived base stock(s), and wax-derived hydrodewaxed, or hydroisomerized/cat (and/or solvent) dewaxed base stock(s), such as wax isomerates or hydrodewaxates, are recited in U.S. Pat. Nos. 6,080,301; 6,090,989, and 6,165,949, for example.

Base stock(s) and/or base oil(s) derived from waxy feeds, which are also suitable for use as the Group III stocks in this invention, are paraffinic fluids of lubricating viscosity derived from hydrodewaxed, or hydroisomerized/cat (and/or solvent) dewaxed waxy feed stocks of mineral oil, non-mineral oil, non-petroleum, or natural source origin, e.g. feed stocks such as one or more of gas oils, slack wax, waxy fuels hydrocracker bottoms, hydrocarbon raffinates, natural waxes, hydrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stock(s) and/or base oil(s).

Slack wax is the wax recovered from any waxy hydrocarbon oil including synthetic oil such as F-T waxy oil or petroleum oils by solvent or auto-refrigerative dewaxing. Solvent dewaxing employs chilled solvent such as methyl ethyl ketone (MEK), methyl isobutyl ketone (MIBK), mixtures of MEK/MIBK, mixtures of MEK and toluene, while auto-refrigerative dewaxing employs pressurized, liquefied low boiling hydrocarbons such as propane or butane.

Slack waxes secured from synthetic waxy oils such as F-T waxy oil will usually have zero or nil sulfur and/or nitrogen containing compound content. Slack wax(es) secured from petroleum oils, may contain sulfur and nitrogen-containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The process of making the lubricant oil base stocks from waxy stocks, e.g. slack wax, F-T wax or waxy feed, may be characterized as an isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst.

Following any needed hydrodenitrogenation or hydrosulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, Offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feed stock may be conducted over a combination of Pt/zeolite beta and Pt/ZSM-23 catalysts or over such catalysts used in series in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over a catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269.

A dewaxing step, when needed, may be accomplished using one or more of solvent dewaxing, catalytic dewaxing or hydrodewaxing processes or combinations of such processes in any sequence.

In solvent dewaxing, the hydroisomerate may be contacted with chilled solvents such as acetone, methyl ethyl ketone (MEK), methyl isobutyl ketone (MIBK), mixtures of ME/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Auto-refrigerative dewaxing using low molecular weight hydrocarbons, such as propane, can also be used in which the hydroisomerate is mixed with, e.g., liquid propane, at least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention.

In catalytic dewaxing the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials which are separated from the heavier base stock fraction. This base stock fraction can then be fractionated into two or more base stocks. Separation of the lower boiling material may be accomplished either prior to or during fractionation of the heavy base stock fraction material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or RON, and the silicoaluminophosphates known as SAPOs. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400 to 600° F., a pressure of 500 to 900 psig, $H_2$ treat rate of 1500 to 3500 SCF/B for flow-through reactors and LHSV of 0.1 to 10, preferably 0.2 to 2.0. The dewaxing is typically conducted to convert no more than 40 wt % and preferably no more than 30 wt % of the hydroisomerate having an initial boiling point in the range of 650 to 750° F. to material boiling below its initial boiling point.

Cobase stocks or cobase oils may also be a Group IV base stock which for the purposes of this specification and the appended claims are identified as polyalpha olefins.

The polyalpha olefins (PAOs) in general are typically comprised of relatively low molecular weight hydrogenated polymers or oligomers of polyalphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins.

The PAO fluids may be conveniently made by the polymerization of an alphaolefin in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl proprionate. For example, the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The PAOs useful in the present invention can also be made by metallocene catalysis. The metallocene-catalyzed PAO (mPAO) can be a copolymer made from at least two alphaolefins or more, or a homo-polymer made from a single alphaolefin feed by a metallocene catalyst system.

The metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion. mPAO and methods for producing mPAO employing metallocene catalysis are described in WO 2009/123800, WO 2007/011832 and U.S. Published Application 2009/0036725.

The copolymer mPAO composition is made from at least two alphaolefins of $C_3$ to $C_{30}$ range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers of the invention can be isotactic, atactic, syndiotactic polymers or any other form of appropriate taciticity.

mPAO can also be made from mixed feed Linear Alpha Olefins (LAOS) comprising at least two and up to 26 different linear alphaolefins selected from $C_3$ to $C_{30}$ linear alphaolefins. In a preferred embodiment, the mixed feed LAO is obtained from an ethylene growth processing using an aluminum catalyst or a metallocene catalyst. The growth olefins comprise mostly $C_6$ to $C_{18}$ LAO. LAOs from other processes can also be used.

The homo-polymer mPAO composition is made from single alphaolefin choosing from $C_3$ to $C_{30}$ range, preferably $C_3$ to $C_{16}$, most preferably $C_3$ to $C_{14}$ or $C_3$ to $C_{12}$. The homo-polymers can be isotactic, atactic, syndiotactic polymers or any other form of appropriate taciticity. Often the taciticity can be carefully tailored by the polymerization catalyst and polymerization reaction condition chosen or by the hydrogenation condition chosen.

The alphaolefin(s) can be chosen from any component from a conventional LAO production facility or from a refinery. It can be used alone to make homo-polymer or together with another LAO available from a refinery or chemical plant, including propylene, 1-butene, 1-pentene, and the like, or with 1-hexene or 1-octene made from a dedicated production facility. In another embodiment, the alphaolefins can be chosen from the alphaolefins produced from Fischer-Tropsch synthesis (as reported in U.S. Pat. No. 5,382,739). For example, $C_3$ to $C_{16}$ alphaolefins, more preferably linear alphaolefins, are suitable to make homo-polymers. Other combinations, such as $C_4$- and $C_{14}$-LAO, $C_6$- and $C_{16}$-LAO, $C_8$-, $C_{10}$-, $C_{12}$-LAO, or $C_8$- and $C_{14}$-LAO, $C_6$-, $C_{10}$-, $C_{14}$-LAO, $C_4$- and $C_{12}$-LAO, etc., are suitable to make copolymers.

A feed comprising a mixture of LAOs selected from $C_3$ to $C_{30}$ LAOs or a single LAO selected from $C_3$ to $C_{16}$ LAO, is contacted with an activated metallocene catalyst under oligomerization conditions to provide a liquid product suitable for use in lubricant components or as functional fluids. This invention is also directed to a copolymer composition made from at least two alphaolefins of $C_3$ to $C_{30}$ range and having monomers randomly distributed in the polymers. The phrase "at least two alphaolefins" will be understood to mean "at least two different alphaolefins" (and similarly "at least three alphaolefins" means "at least three different alphaolefins", and so forth).

The product obtained is an essentially random liquid copolymer comprising the at least two alphaolefins. By "essentially random" is meant that one of ordinary skill in the art would consider the products to be random copolymer. Likewise, the term "liquid" will be understood by one of ordinary skill in the art as meaning liquid under ordinary conditions of temperature and pressure, such as ambient temperature and pressure.

The process employs a catalyst system comprising a metallocene compound (Formula 1, below) together with an activator such as a non-coordinating anion (NCA) (Formula 2, below) or methylaluminoxane (MAO) 1111 (Formula 3, below):

Formula 1

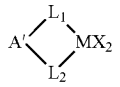

-continued

Formula 2

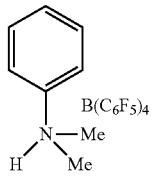

NCA

Formula 3

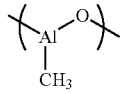

MAO

The term "catalyst system" is defined herein to mean a catalyst precursor/activator pair, such as a metallocene/activator pair. When "catalyst system" is used to describe such a pair before activation, it means the unactivated catalyst (precatalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkyl aluminum compound, is also used as an impurity scavenger.

The metallocene is selected from one or more compounds according to Formula 1 above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated. A is an optional bridging group which, if present, in preferred embodiments is selected from dialkylsilyl, dialkylmethyl, diphenylsilyl or diphenylmethyl, ethylenyl ($—CH_2—CH_2$), alkylethylenyl ($—CR_2—CR_2$), where alkyl can be independently $C_1$ to $C_{16}$ alkyl radical or phenyl, tolyl, xylyl radical and the like, and wherein each of the two X groups, Xa and Xb, are independently selected from halides OR (R is an alkyl group, preferably selected from $C_1$ to $C_5$ straight or branched chain alkyl groups), hydrogen, $C_1$ to $C_{16}$ alkyl or aryl groups, haloalkyl, and the like. Usually relatively more highly substituted metallocenes give higher catalyst productivity and wider product viscosity ranges and are thus often more preferred.

Any of the polyalphaolefins preferably have a Bromine number of 1.8 or less as measured by ASTM D1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less. If necessary, the polyalphaolefins can be hydrogenated to achieve a low bromine number.

Any of the mpolyalphaolefins (mPAO) described herein may have monomer units represented by Formula 4 in addition to the all regular 1,2-connection:

Formula 4

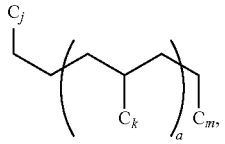

where j, k and m are each, independently, 3, 4, 5, 6, 7, 8, 9, 10, 11, 12, 13, 14, 15, 16, 17, 18, 19, 20, 21 or 22, n is an integer from 1 to 350 (preferably 1 to 300, preferably 5 to 50) as measured by proton NMR.

Any of the mpolyalphaolefins (mPAO) described herein preferably have an Mw (weight average molecular weight) of 100,000 or less, preferably between 100 and 80,000, preferably between 250 and 60,000, preferably between 280 and 50,000, preferably between 336 and 40,000 g/mol.

Any of the mpolyalphaolefins (mPAO) described herein preferably have a Mn (number average molecular weight) of 50,000 or less, preferably between 200 and 40,000, preferably between 250 and 30,000, preferably between 500 and 20,000 g/mol.

Any of the mpolyalphaolefins (mPAO) described herein preferably have a molecular weight distribution (MWD-Mw/Mn) of greater than 1 and less than 5, preferably less than 4, preferably less than 3, preferably less than 2.5. The MWD of mPAO is always a function of fluid viscosity. Alternately, any of the polyalphaolefins described herein preferably have an Mw/Mn of between 1 and 2.5, alternately between 1 and 3.5, depending on fluid viscosity.

Molecular weight distribution (MWD), defined as the ratio of weight-averaged MW to number-averaged MW (=Mw/Mn), can be determined by gel permeation chromatography (GPC) using polystyrene standards, as described in p. 115 to 144, Chapter 6, The Molecular Weight of Polymers in "Principles of Polymer Systems" (by Ferdinand Rodrigues, McGraw-Hill Book, 1970). The GPC solvent was HPLC Grade tetrahydrofuran, uninhibited, with a column temperature of 30° C., a flow rate of 1 ml/min, and a sample concentration of 1 wt %, and the Column Set is a Phenogel 500 A, Linear, 10E6A.

Any of the m-polyalphaolefins (mPAO) described herein may have a substantially minor portion of a high end tail of the molecular weight distribution. Preferably, the mPAO has not more than 5.0 wt % of polymer having a molecular weight of greater than 45,000 Daltons. Additionally or alternatively, the amount of the mPAO that has a molecular weight greater than 45,000 Daltons is not more than 1.5 wt %, or not more than 0.10 wt %. Additionally or alternatively, the amount of the mPAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

In a preferred embodiment of this invention, any PAO described herein may have a pour point of less than 0° C. (as measured by ASTM D97), preferably less than −10° C., preferably less than 20° C., preferably less than −25° C., preferably less than −30° C., preferably less than −35° C., preferably less than −50° C., preferably between −10° C. and −80° C., preferably between −15° C. and −70° C.

Polyalphaolefins made using metallocene catalysis may have a kinematic viscosity at 100° C. from about 1.5 to about 5,000 cSt, preferably from about 2 to about 3,000 cSt, preferably from about 3 cSt to about 1,000 cSt, more preferably from about 29 cSt to about 1,000 cSt, and yet more preferably from about 40 cSt to about 500 cSt as measured by ASTM D445.

PAOs useful in the present invention include those made by the process disclosed in U.S. Pat. Nos. 4,827,064 and 4,827,073. Those PAO materials, which are produced by the use of a reduced valence state chromium catalyst, are olefin oligomers of polymers which are characterized by very high viscosity indices which give them very desirable properties to be useful as lubricant base stocks and, with higher viscosity grades, as VI improvers. They are referred to as High Viscosity Index PAOs or HVI-PAOs. The relatively low molecular weight high viscosity PAO materials were found to be useful as lubricant base stocks whereas the higher viscosity PAOs, typically with viscosities of 100 cSt or more, e.g. in the range of 100 to 1,000 cSt, were found to be very effective as viscosity index improvers for conventional PAOs and other synthetic and mineral oil derived base stocks.

Various modifications and variations of these high viscosity PAO materials are also described in the following U.S. Patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. Nos. 5,012,020 and 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally have a viscosity in the range of about 12 to 5,000 cSt.

Furthermore, the HVI-PAOs generally can be characterized by one or more of the following: $C_{30}$ to $C_{1300}$ hydrocarbons having a branch ratio of less than 0.19, a weight average molecular weight of between 300 and 45,000, a number average molecular weight of between 300 and 18,000, a molecular weight distribution of between 1 and 5. Particularly preferred HVI-PAOs are fluids with 100° C. viscosity ranging from 29 to 5000 $mm^2/s$. In another embodiment, viscosities of the HVI-PAO oligomers measured at 100° C. range from 3 $mm^2/s$ to 15,000 $mm^2/s$. Furthermore, the fluids with viscosity at 100° C. of 3 $mm^2/s$ to 5000 $mm^2/s$ have VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of $C_6$ to $C_{20}$ 1-alkenes. Examples of the feeds can be 1-hexene, 1-octene, 1-decene, 1-dodecene, 1-tetradecene, etc. or mixture of $C_6$ to $C_{14}$ 1-alkenes or mixture of $C_6$ to $C_{20}$ 1-alkenes, $C_6$ and $C_{12}$ 1-alkenes, $C_6$ and $C_{14}$ 1-alkenes, $C_6$ and $C_{16}$ 1-alkenes, $C_6$ and $C_{18}$ 1-alkenes, $C_8$ and $C_{10}$ 1-alkenes, $C_8$ and $C_{12}$ 1-alkenes, $C_8$, $C_{10}$ and $C_{12}$ 1-alkenes, and other appropriate combinations.

The lube products usually are distilled to remove any low molecular weight compositions such as those boiling below 600° F., or with carbon numbers less than $C_{20}$, if they are produced from the polymerization reaction or are carried over from the starting material.

The lube fluids made directly from the polymerization or oligomerization process usually have unsaturated double bonds or have olefinic molecular structure. The amount of double bonds or unsaturation or olefinic components can be measured by several methods, such as bromine number (ASTM D1159), bromine index (ASTM D2710) or other suitable analytical methods, such as NMR, IR, etc. The amount of the double bond or the amount of olefinic compositions depends on several factors—the degree of polymerization, the amount of hydrogen present during the polymerization process and the amount of other promoters which anticipate in the termination steps of the polymerization process, or other agents present in the process. Usually the amount of double bonds or the amount of olefinic components is decreased by the higher degree of polymerization, the higher amount of hydrogen gas present in the polymerization process or the higher amount of promoters participating in the termination steps.

As with the other PAOs, the oxidative stability and light or UV stability of HVI-PAO fluids improves when the amount of unsaturation double bonds or olefinic contents is reduced. Therefore, it is necessary to further hydrotreat the polymer if they have high degree of unsaturation. Usually the fluids with bromine number of less than 5, as measured by ASTM D1159, is suitable for high quality base stock application. Of course, the lower the bromine number, the better the lube quality. Fluids with bromine numbers of less than 3 or 2 are common. The most preferred range is less than 1 or less than 0.1. The method to hydrotreat to reduce the degree of unsaturation is well known in literature (U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, it can be used as is without hydrotreating, or it can be hydrotreated to further improve the base stock properties.

The PAO fluid may be a high kinematic viscosity fluid that is a PAO with a kinematic viscosity at 100° C. in the range of at least 29 $mm^2/s$, preferably 29 to 1000 $mm^2/s$, more preferably 29 to 600 $mm^2/s$, still more preferably 29 to 300 $mm^2/s$, most preferably 29 to 150 $mm^2/s$.

When discussing PAO, the designation of a PAO as, e.g. PAO 150, means a PAO with a kinematic viscosity at 100° C. of nominally 150 $mm^2/s$.

Such higher kinematic viscosity PAO fluids can be made using the same techniques previously recited for the production of the low kinematic viscosity PAO fluids. Preferably the high kinematic viscosity PAO fluid is made employing metallocene catalysis or the process described in U.S. Pat. No. 4,827,064 or 4,827,073.

Detergents

The detergent is a mixture of one or more metal sulfonate(s) and/or metal phenate(s) with one or more metal salicylate(s). The metals are any alkali or alkaline earth metals; e.g., calcium, barium, sodium, lithium, potassium, magnesium, more preferably calcium, barium and magnesium. It is a feature of the present lubricating oil that each of the metal salts used in the mixture has the same or substantially the same TBN as the other metal salts in the mixture; thus, the mixture can comprise one or more metal sulfonate(s) and/or metal phenate combined with one or more metal salicylate(s) wherein each of the one or more metal salts is a low TBN detergent, or each is a medium TBN detergent or each is a high TBN detergent. Preferably each are low TBN detergent, each metal detergent having the same or substantially the same similar TBN below about 100. For the purposes of the specification and the claims, for the metal salts, by low TBN is meant a TBN of less than 100; by medium TBN is meant a TBN between 100 to less than 250; and by high TBN is meant a TBN of about 250 and greater. By the same or substantially similar TBN is meant that even as within a given TBN category; e.g., low, medium and high, the TBNs of the salts do not simply fall within the same TBN category but are close to each other in absolute terms. Thus, a mixture of sulfonate and/or phenate with salicylate of low TBN would not only be made up of salts of TBN less than 100, but each salt would have a TBN substantially the same as that of the other salts in the mixture; e.g., a sulfonate of TBN 60 paired with a salicylate of TBN 64, or a phenate of TBN 65 paired with a salicylate of TBN 64. Thus, the individual salts would not have TBNs at the extreme opposite end of the applicable TBN category, or varying substantially from each other.

The TBNs of the salts will differ by no more than about 15%, preferably no more than about 12%, more preferably no more than about 10% or less.

The one or more metal sulfonate(s) and/or metal phenate(s), and the one or more metal salicylate(s) are utilized in the detergent as a mixture, for example, in a ratio by parts of 5:95 to 95:5, preferably 10:90 to 90:10, more preferably 20:80 to 80:20.

The mixture of detergents comprises a first metal salt or group of metal salts selected from the group consisting of one or more metal sulfonates(s), salicylate(s), phenate(s) and mixtures thereof having a high TBN of greater than about 150 to 300 or higher, preferably about 160 to 300, used in an amount in combination with the other metal salts or groups of metal salts (recited below) sufficient to achieve a lubricating oil of at least 0.65 wt % sulfated ash content, a second metal salt or group of metal salts selected from the group consisting of one or more metal salicylate(s), metal sulfonate(s), metal phenate(s) and mixtures thereof having a medium TBN of greater than about 50 to 150, preferably about 60 to 120, and a third metal salt or group of metal salts selected from the group consisting of one or more metal sulfonate(s), metal salicylate(s) and mixtures thereof identified as neutral or low TBN, having a TBN of about 10 to 50, preferably about 20 to 40, the total amount of medium plus neutral/low TBN detergent being about 0.7 vol % or higher (active ingredient), preferably about 0.9 vol % or higher (active ingredient), most preferably about 1 vol % or higher (active ingredient), wherein at least one of the medium or low/neutral TBN detergent(s) is metal salicylate, preferably at least one of the medium TBN detergent(s) is a metal salicylate. The total amount of high TBN detergents is about 0.3 vol % or higher (active ingredient), preferably about 0.4 vol % or higher (active ingredient), most preferably about 0.5 vol % or higher (active ingredient). The mixture contains salts of at least two different types, with medium or neutral salicylate being an essential component. The volume ratio (based on active ingredient) of the high TBN detergent to medium plus neutral/low TBN detergent is in the range of about 0.15 to 3.5, preferably 0.2 to 2, most preferably about 0.25 to 1.

The mixture of detergents is added to the lubricating oil formulation in an amount up to about 10 vol % based on active ingredient in the detergent mixture, preferably in an amount up to about 8 vol % based on active ingredient, more preferably 6 vol % based on active ingredient in the detergent mixture, even more preferably between about 1.5 to 5.0 vol %, based on active ingredient in the detergent mixture, and most preferably between about 0.3 vol % to 3 vol % based on active ingredient in the detergent mixture. Preferably, the total amount of metal salicylate(s) used of all TBNs is in the range of between 0.5 vol % to 4.5 vol %, based on active ingredient of metal salicylate.

The marine lubricating oil and method of making and use can use engine lubricating oils containing additional performance additives provided the lubricating oil includes the molydithiocarbamate friction modifier and zinc dithiocarbamate anti-wear additive As indicated, the detergents employed are alkali and/or alkaline earth metal, preferably alkaline earth metal, more preferably calcium, salicylates, phenates, sulfonates, carboxylates used either singly or in various combinations. These detergents can be low, medium or high TBN detergents, i.e. detergents with base numbers ranging from about 5 to as high as 500 mg KOH/g, preferably about 5 to about 400 mg KOH/g.

Other Lubricating Oil Additives

The formulated lubricating oil useful in the present invention may additionally contain one or more of the other commonly used lubricating oil performance additives including but not limited to dispersants, additional other detergents, corrosion inhibitors, rust inhibitors, metal deactivators, other anti-wear and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the present invention in lubricant compositions are not limited by the examples shown herein as illustrations.

Viscosity Improvers

Viscosity improvers (also known as Viscosity Index modifiers, and VI improvers) provide lubricants with high and low temperature operability. These additives increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between about 1,000 to 1,000,000, more typically about 2,000 to 500,000, and even more typically between about 2,500 and 200,000.

Examples of suitable viscosity improvers are polymers and copolymers of methacrylate, butadiene, olefins, or alkylated styrenes. Polyisobutylene is a commonly used viscosity improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 10 wt %, preferably zero to 6 wt %, more preferably zero to 4 wt % based on active ingredient and depending on the specific viscosity modifier used.

Anti-Oxidants

Typical anti-oxidant include phenolic anti-oxidants, aminic anti-oxidants and oil-soluble copper complexes.

The phenolic anti-oxidants include sulfurized and non-sulfurized phenolic anti-oxidants. The terms "phenolic type" or "phenolic anti-oxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such biphenol compounds linked by alkylene bridges sulfuric bridges or oxygen bridges. Alkyl phenols include mono- and poly-alkyl or alkenyl phenols, the alkyl or alkenyl group containing from about 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R)_x—Ar—(OH)_y$$

where Ar is selected from the group consisting of:

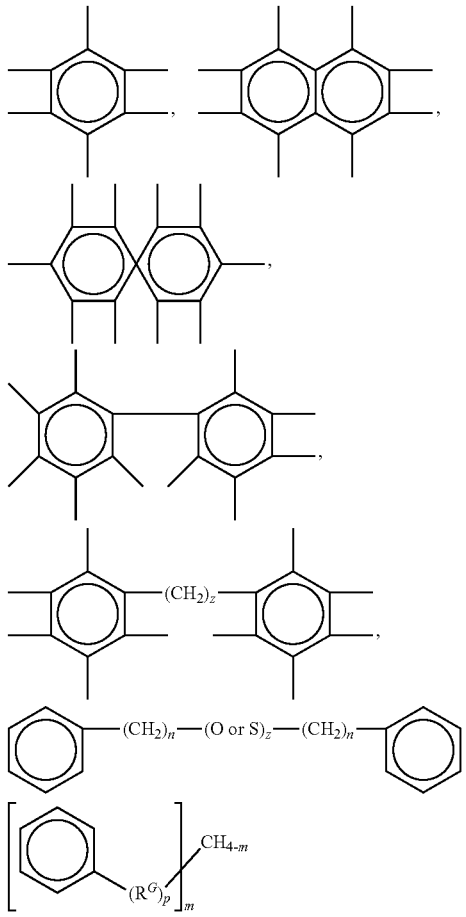

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic anti-oxidant compounds are the hindered phenolics which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol.

Phenolic type anti-oxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic anti-oxidants which can be used.

Aromatic amine anti-oxidants include phenyl-a-naphthyl amine which is described by the following molecular structure:

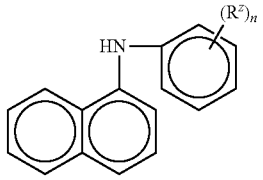

wherein $R^z$ is hydrogen or a $C_1$ to $C_{14}$ linear or $C_3$ to $C_{14}$ branched alkyl group, preferably $C_1$ to $C_{10}$ linear or $C_3$ to $C_{10}$ branched alkyl group, more preferably linear or branched $C_6$ to $C_8$ and n is an integer ranging from 1 to 5 preferably 1. A particular example is Irganox L06.

Other aromatic amine anti-oxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines anti-oxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of such other additional amine anti-oxidants which may be present include diphenylamines, phenothiazines, imidodibenzyls and diphenyl phenylene diamines. Mixtures of two or more of such other additional aromatic amines may also be present. Polymeric amine anti-oxidants can also be used.

Another class of anti-oxidant used in lubricating oil compositions and which may be present in addition to the necessary phenyl-a-naphthylamine is oil-soluble copper compounds. Any oil-soluble suitable copper compound may be blended into the lubricating oil. Examples of suitable copper anti-oxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Such anti-oxidants may be used in an amount of about 0.10 to 5 wt %, preferably about 0.30 to 3 wt % (on an as-received basis).

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon sub stituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. Process aids and catalysts, such as oleic acid and sulfonic acids, can also be part of the reaction mixture. Molecular weights of the alkylphenols range from 800 to 2,500.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %, more preferably about 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers.

Such additives may be used in amount of about 0.0 to 0.5 wt %, preferably about 0 to 0.3 wt %, more preferably about 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof.

Such additives may be used in an amount of about 0.01 to 5 wt %, preferably about 0.01 to 1.5 wt %, more preferably about 0.01 to 0.2 wt %, still more preferably about 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt % on an as-received basis.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent, preferably 0.001 to about 0.5 wt %, more preferably about 0.001 to about 0.2 wt %, still more preferably about 0.0001 to 0.15 wt % (on an as-received basis) based on the total weight of the lubricating oil composition.

Inhibitors and Anti-Rust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt % on an as-received basis.

Anti-wear additives can also advantageously be present. Anti-wear additives are exemplified by metal dithiophosphate, metal dithiocarbamate (preferably zinc dithiocarbamate), metal dialkyl dithiophosphate, metal xanthage where the metal can be zinc or molybdenum. Tricresylphosphates are another type of anti-wear additive. Such anti-wear additives can be present in an amount of about 0.05 to 1.5 wt %, preferably about 0.1 to 1.0 wt %, more preferably about 0.2 to 0.5 wt % (as received).

EXAMPLES

Comparative Examples and Examples

A series of marine lubricating oils were evaluated in regard to the effect of base stock composition type (Group I, Group III) and viscosity, cobase composition type (Group V PMA, Group I, Group IV PAO, Group V PIB) and viscosity, friction modifier type (inventive molybdenum dithiocarbamate) and anti-wear additive type (comparative ZDDP and inventive zinc dithiocarbamate). The inventive marine lubricating oils utilized a bimodal base stock blend including a low viscosity Group III base stock and a high viscosity co-base stock in combination with a friction modifier and anti-wear additive. The cobase stock was a Group I base stock, a Group IV base stock, a Group V base stock or combinations thereof.

The formulations in addition to the different base stocks, cobase stocks, friction modifiers and anti-wear additives in the formulations also all contained the same types of other lubricating oil additives, indicated in the Figures as "rest of formulation." The Table below gives a summary of the components that were used in the comparative and the inventive marine lubricating oil formulations.

| Type | % Wt | Description |
|---|---|---|
| Group III, GTL kv 100 < 10 cSt | 15-100 | ex. SHELL QHVI 8, QHVI 4 |
| Molybdenum friction modifier | 0.1 to 2 | ex. ADEKA SAKURALUBE 165, ADEKA SAKULALUBE 525, Molyvan L |
| Zinc Dithiocarbamate | 0.1 to 2 | VANLUBE AZ |
| Co-Basestock wt kV 100 > 29 cSt | 0-75 | PAO, PMA, PIB, Gp1 |
| Other Additives | 2 to 30 | Detergents, anti-oxidants, anti-foam, dispersants . . . |

| | min | max |
|---|---|---|
| Total additive | 2 | 42 |
| Total basestock | 68 | 98 |

The traction coefficient of inventive and comparative oils was measured employing the MTM Traction Rig which is a fully automated Mini Traction Machine traction measurement instrument. The rig is manufactured by PCS Instruments and identified as Model MTM. The test specimens and apparatus configuration are such that realistic pressures, temperatures and speeds can be attained without requiring very large loads, motors or structures. A small sample of fluid (50 ml) is placed in the test cell and the machine automatically runs through a range of speeds, slide-to-roll ratios, temperatures and loads to produce a comprehensive traction map for the test fluid without operational intervention. The standard test specimens are a polished 19.05 mm ball and a 50.0 mm diameter disc manufactured from AISI 52100 bearing steel. The specimens are designed to be single use, throw away items. The ball is loaded against the face of the disc and the ball and disc are driven independently by DC servo motors and drives to allow high precision speed control, particularly at low slide/roll ratios. Each specimen is end mounted on shafts in a small stainless steel test fluid bath. The vertical shaft and drive system which supports the disk test specimen is fixed. However, the shaft and drive system which supports the ball test specimen is supported by a gimbal arrangement such that it can rotate around two orthogonal axes. One axis is normal to the load application direction, the other to the traction force direction. The ball and disk are driven in the same direction. Application of the load and restraint of the traction force is made through high stiffness force transducers appropriately mounted in the gimbal arrangement to minimize the overall support system deflections. The output from these force transducers is monitored directly by a personal computer. The traction coefficient is the ratio of the traction force to the applied load. As shown in FIGS. 1 and 10-13, the traction coefficient was measured over a range of speeds. In FIGS. 1 and 10-13, the speed on the x-axis is the entrainment speed, which is half the sum of the ball and disk speeds. These entrainment speeds simulate the range of surface speeds, or at least a portion of the range of surface speeds, reached when the engine is operating.

The test results presented herein were generated under the following test conditions:

| | |
|---|---|
| Temperature | 100° C. |
| Load | 1.0 GPa |
| Slide-to-roll ratio (SRR) | 50% |
| Speed gradient | 0-3000 mm/sec in 480 seconds |

Inventive and comparative marine lubricating oils were evaluated by MTM under standard conditions shown to directionally correlate with field data at 50% SRR, 1 Gpa, 100 C and 3.2 m/s speed. TBN2896 and KV100 were calculated values. FIG. 1 is a graphical representation of mini traction machine (MTM) traction coefficient versus rolling speed illustrating the contribution of each element of the inventive marine lubricating oil composition to reduced friction and in comparison to comparative marine lubricating oils including ZDDP as the antiwear additive.

Inventive and comparative marine lubricating oil formulations with different contents of Mo and ZDTC were formulated according to FIG. 2 and tested. In addition, inventive and comparative marine lubricating oil formulations for marine system oils of low base number and SAE 30 grades were formulated according to FIG. 3 and tested. Moreover, inventive and comparative marine lubricating oil formulations for marine system oils of low base number and SAE 20 and SAE 30 grades were formulated according to FIG. 4 and tested.

Inventive and comparative marine lubricating oil formulations for marine trunk piston engine oils of medium base number and SAE 40 grades were formulated according to FIG. 5 and tested. Inventive and comparative marine lubricating oil formulations for marine cylinder oils of medium base number and SAE 50 grades were formulated according to FIG. 6 and tested. Additional inventive and comparative marine lubricating oil formulations for marine cylinder oils of medium base number and SAE 50 grades were formulated according to FIG. 7 and tested.

Inventive and comparative marine lubricating oil formulations for marine cylinder oils of high base number and SAE 50 grades were formulated according to FIG. 8 and tested. Still yet additional inventive and comparative marine lubricating oil formulations for marine cylinder oils of high base number and SAE 50 grades were formulated according to FIG. 9 and tested.

Figure 10:
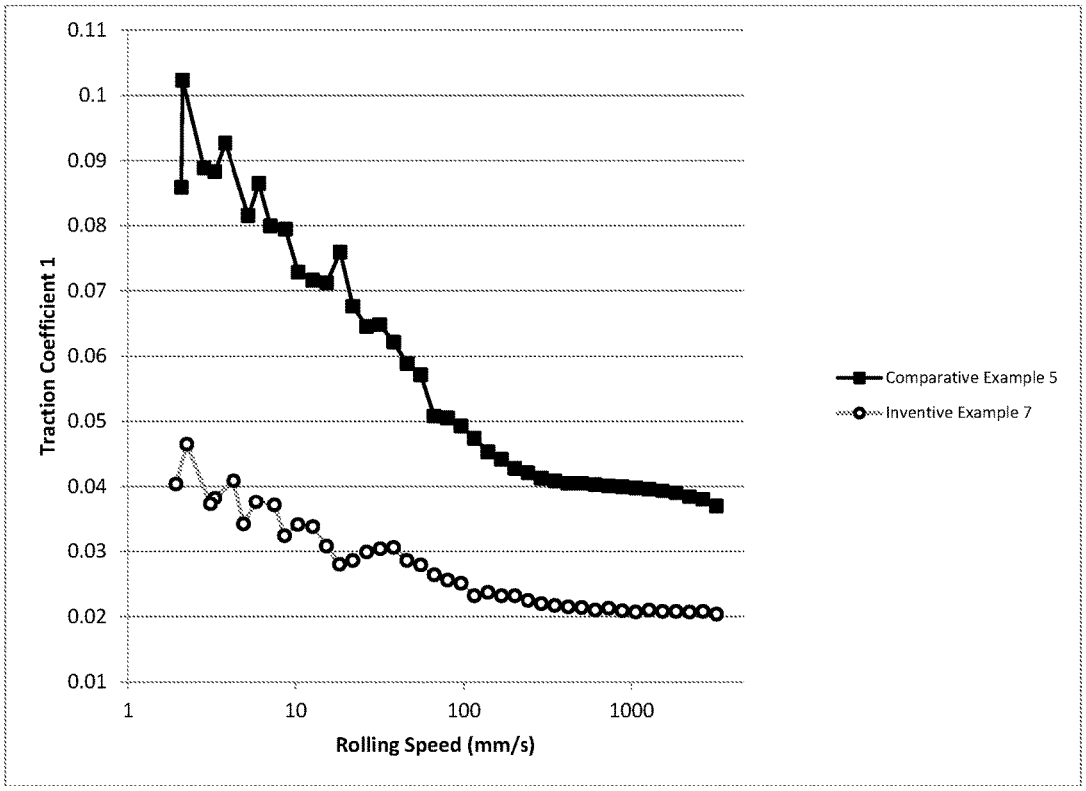
FIG. 10 is a graphical representation of mini traction machine (MTM) traction coefficient versus rolling speed for a comparative and inventive marine diesel engine system oil of 9 TBN.

FIG. 10 is a graphical representation of mini traction machine (MTM) traction coefficient versus rolling speed for a comparative and inventive marine diesel engine system oil of 9 TBN.

Figure 11:
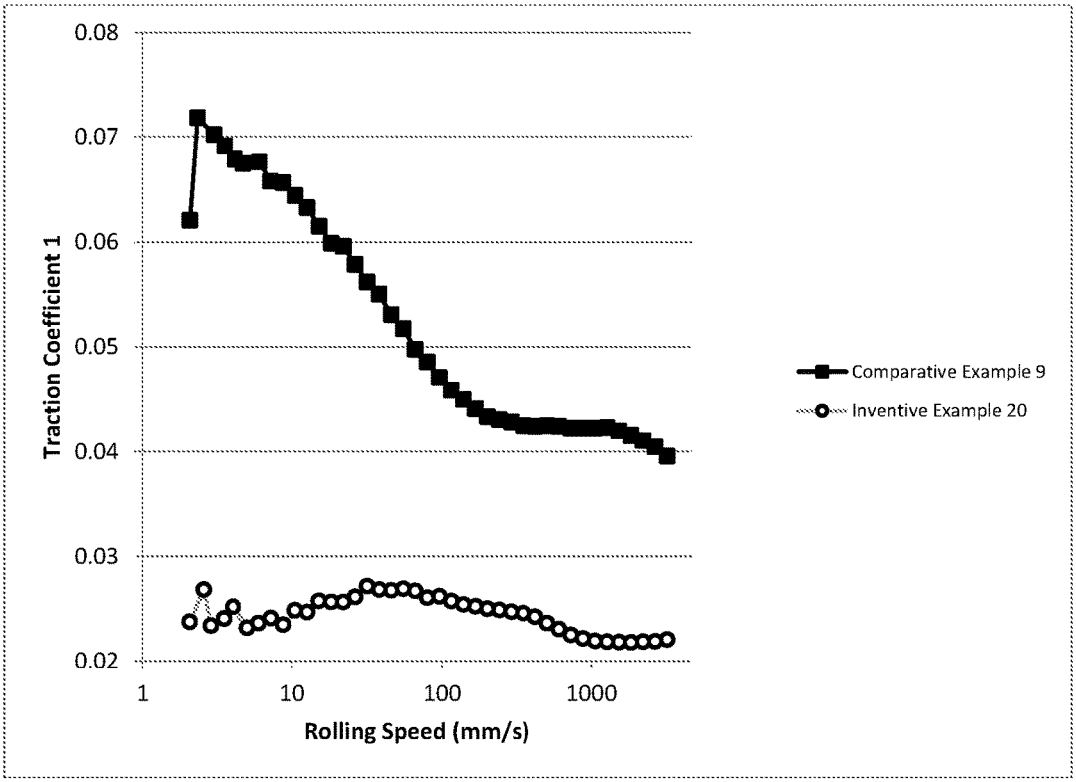
FIG. 11 is a graphical representation of mini traction machine (MTM) traction coefficient versus rolling speed for a comparative and inventive marine diesel engine cylinder oil of 35 TBN.

FIG. 11 is a graphical representation of mini traction machine (MTM) traction coefficient versus rolling speed for a comparative and inventive marine diesel engine cylinder oil of 35 TBN.

Figure 12:
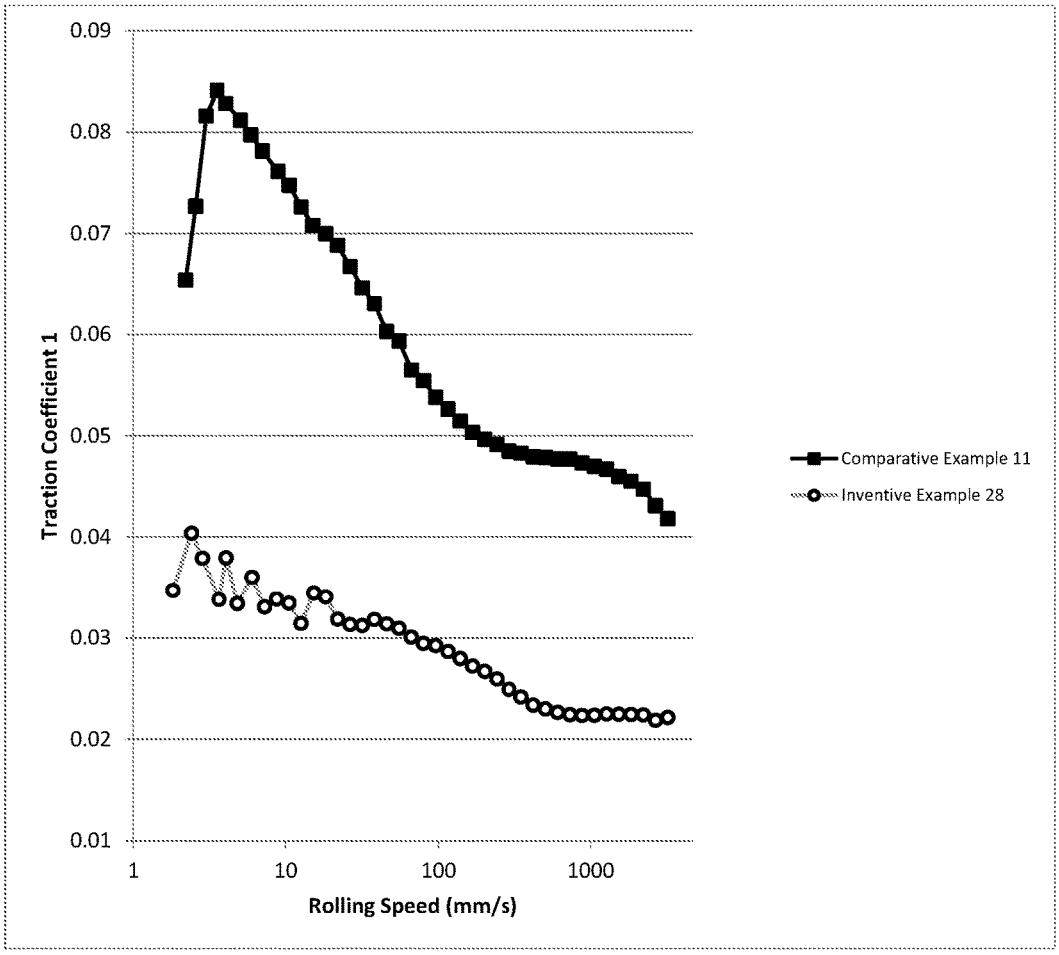
FIG. 12 is a graphical representation of mini traction machine (MTM) traction coefficient versus rolling speed for a comparative and inventive marine diesel engine cylinder oil of 70 TBN.

FIG. 12 is a graphical representation of mini traction machine (MTM) traction coefficient versus rolling speed for a comparative and inventive marine diesel engine cylinder oil of 70 TBN.

Figure 13:
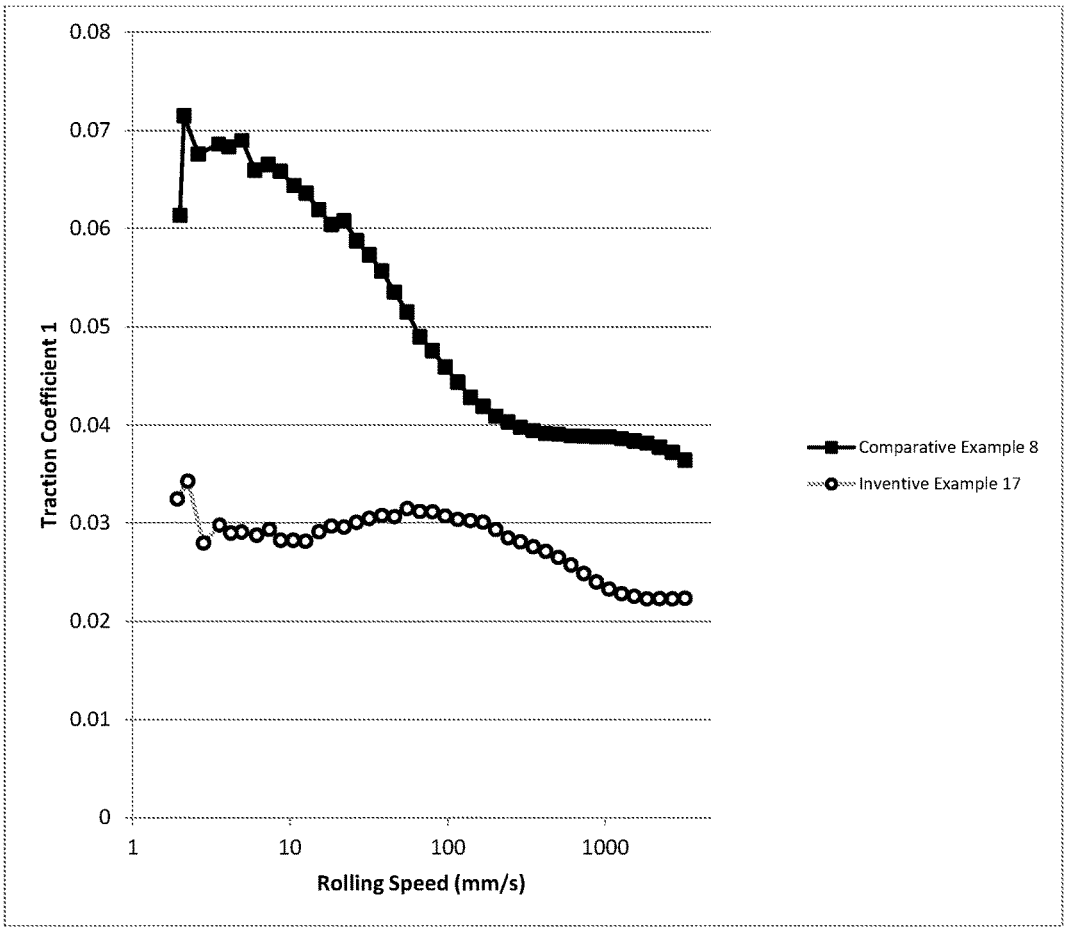
FIG. 13 is a graphical representation of mini traction machine (MTM) traction coefficient versus rolling speed for a comparative and inventive marine trunk piston diesel engine oil of 40 TBN.

FIG. 13 is a graphical representation of mini traction machine (MTM) traction coefficient versus rolling speed for a comparative and inventive marine trunk piston diesel engine oil of 40 TBN.

The brake specific fuel consumption of the inventive and comparative oils were measured employing a Bolnes 3DNL 190/600 two-stroke marine diesel crosshead engine. Brake specific fuel consumption was measured in grams per kilowatt hour while running the engine at a constant speed and load. An experimental design was used where the comparative oil was run followed by the inventive oil and then the comparative oil was run again. This experimental design allows for a statistically significant discrimination of the oils being tested.

FIG. 14 is a table showing the brake specific fuel consumption of an inventive and comparative marine cylinder oil run used in a Bolnes 3DNL 190/600 two-stroke marine diesel crosshead engine. Ninety percent confidence ranges are shown and were calculated using Tukey's method.

The brake specific fuel consumption of inventive and comparative oils were measured employing a Wartsila 6 L20 4-stroke marine diesel engine. Brake specific fuel consumption was measured in grams per kilowatt hour while running the engine in four different modes as shown in FIG. 15. This test cycle is based on cycle E2 Table 6 of ISO 8178-4:2007 test procedure. Each engine mode keeps the speed constant, but varies the load. Five sets of the four modes were run in accordance with increasing power, while keeping various engine parameters such as coolant temperature, inlet air temperature, etc. constant as shown in FIG. 16 for testing cycle parameters. An experimental design was used where the comparative oil was run followed by the inventive oil and then the comparative oil was run again allowing for statistically significant discrimination of the oils.

The brake specific fuel consumption of inventive and comparative oils were measured employing a small-scale 2-stroke marine crosshead diesel research engine. The engine was used to evaluate both cylinder oils and system oils. The engine design specifications, as shown in FIG. 17, replicate key modern engine parameters such as stroke:bore ratio, operating pressures, and liner temperatures to ensure lubricants are subjected to conditions (i.e. temperature, pressure, shear, combustion, etc.) similar to those of commercial size engines operating in the field. Brake specific fuel consumption was measured in grams per kilowatt hour while running the engine in six different modes as shown in FIG. 18. This test cycle is based on cycle E2 Table 6 of ISO 8178-4:2007 test procedure. Each engine mode keeps the speed constant, but varies the load. As seen in FIG. 19, five sets of the six modes were run in accordance with increasing power, while keeping various engine parameters such as coolant temperature, inlet air temperature, etc. constant. An experimental design was used where the comparative oil was run followed by the inventive oil and then the comparative oil was run again allowing for statistically significant discrimination of the oils.

EP and PCT Clauses:

1. A marine lubricating oil comprising from 15 to 95 wt % of a Group III base stock having a KV100 of 4 to 12 cSt, 0.5 to 55 wt % of cobase stock having a KV100 of 29 to 1000 cSt, 0.1 to 2.0 wt % of a molydithiocarbamate friction modifier, 0.1 to 2.0 wt % of a zinc dithiocarbamate anti-wear additive, and 2 to 30 wt % of other lubricating oil additives, and wherein the cobase stock is selected from the group consisting of a Group I, a Group IV, a Group V and combinations thereof.

2. The oil of clause 1, wherein the Group I cobase stock is bright stock.

3. The oil of clauses 1-2, wherein the Group IV cobase stock is a Friedel-Crafts catalyzed PAO base stock or a metallocene catalyzed PAO base stock.

4. The oil of clauses 1-3, wherein Group V cobase stock is selected from the group consisting of polyisobutylene, polymethacrylate and combinations thereof.

5. The oil of clauses 1-4, wherein the Group III base stock is a GTL base stock.

6. The oil of clauses 1-5, wherein the oil has a KV100 ranging from 7 to 30 cSt.

7. The oil of clauses 1-6, wherein the other lubricating oil additives are selected from the group consisting of viscosity index improvers, antioxidants, detergents, dispersants, pour point depressants, corrosion inhibitors, metal deactivators, seal compatibility additives, anti-foam agents, inhibitors, anti-rust additives, other friction modifiers and other anti-wear additives.

8. The oil of clauses 1-7, wherein the detergents are selected from alkali and/or alkaline earth metal salicylates, phenates, carboxylates, sulfonates, mixtures of phenates and salicylates or mixtures of phenates and carboxylates at a total treat level in an amount of 6 to 30 wt % (active ingredient) of the oil.

9. The oil of clauses 1-8, wherein the oil has a total base number ranging from 8 to 100.

10. The oil of clauses 1-9 used as a cylinder oil, a system oil or a trunk piston engine oil.

11. A method of making a marine lubricating oil comprising the steps of:

providing a Group III base stock having a KV100 of 4 to 12 cSt, a cobase stock having a KV100 of 29 to 1000 cSt selected from the group consisting of a Group I, a Group IV, a Group V and combinations thereof, a molydithiocarbamate friction modifier, a zinc dithiocarbamate anti-wear additive, and other lubricating oil additives, and blending from 15 to 95 wt % of the Group III base stock, 0.5 to 55 wt % of the cobase stock, 0.1 to 2.0 wt % of the molydithiocarbamate friction modifier, 0.1 to 2.0 wt % of the zinc dithiocarbamate anti-wear additive, and 2 to 30 wt % of the other lubricating oil additives to form the marine lubricating oil.

12. The method of clause 11, wherein the Group I cobase stock is bright stock.

13. The method of clauses 11-12, wherein the Group IV cobase stock is a Friedel-Crafts catalyzed PAO base stock or a metallocene catalyzed PAO base stock.

14. The method of clauses 11-13, wherein Group V cobase stock is selected from the group consisting of polyisobutylene, polymethacrylate and combinations thereof.

15. The method of clauses 11-14, wherein the Group III base stock is a GTL base stock.

16. The method of clauses 11-15, wherein the oil has a KV100 ranging from 7 to 30 cSt.

17. The method of clauses 11-16, wherein the other lubricating oil additives are selected from the group consisting of viscosity index improvers, antioxidants, detergents, dispersants, pour point depressants, corrosion inhibitors, metal deactivators, seal compatibility additives, anti-foam agents, inhibitors, anti-rust additives, other friction modifiers and other anti-wear additives.

18. The method of clauses 11-17, wherein the detergents are selected from alkali and/or alkaline earth metal salicylates, phenates, carboxylates, sulfonates, mixtures of phenates and salicylates or mixtures of phenates and carboxylates at a total treat level in an amount of 6 to 30 wt % (active ingredient) of the oil.

19. The method of clauses 11-18, wherein the oil has a total base number ranging from 8 to 100.

20. The method of clauses 11-19, wherein the oil is used in the marine diesel engine as a cylinder oil, a system oil or a trunk piston engine oil.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

The invention claimed is:

1. A marine lubricating oil comprising from 58.9 to 96.05 wt % of a Group III base stock having a KV100 of 4 to 12 cSt, a cobase stock having a KV100 of 29 to 1000 cSt comprising 16.37 to 33.28 wt % of a Group IV base stock or 0.7 to 17.0 wt % of a Group V base stock, 0.1 to 2.0 wt % of a molydithiocarbamate friction modifier, 0.6 to 2.0 wt % of a zinc dithiocarbamate anti-wear additive, 2.24 to 28 wt % of a calcium alkyl salicylate detergent and 0.29 to 0.50 wt % of other lubricating oil additives, and wherein the marine lubricating oil has a total base number (ASTM D2896) ranging from 8.5 to 103 and an MTM boundary traction coefficient (9 mm/s rolling speed) of less than or equal to 0.0413.

2. The marine lubricating oil of claim 1, wherein the Group IV cobase stock is a Friedel-Crafts catalyzed PAO base stock or a metallocene catalyzed PAO base stock.

3. The marine lubricating oil of claim 1, wherein Group V cobase stock is selected from the group consisting of polyisobutylene, polymethacrylate and combinations thereof.

4. The marine lubricating oil of claim 1, wherein the Group III base stock is a GTL base stock.

5. The marine lubricating oil of claim 1, wherein the oil has a KV100 ranging from 8.37 to 23 cSt.

6. The marine lubricating oil of claim 1, wherein the other lubricating oil additives are selected from the group consisting of viscosity index improvers, antioxidants, dispersants, pour point depressants, corrosion inhibitors, metal deactivators, seal compatibility additives, anti-foam agents, inhibitors, anti-rust additives, other friction modifiers and other anti-wear additives.

7. The marine lubricating oil of claim 1 used as a cylinder oil, a system oil or a trunk piston engine oil.

8. The marine lubricating oil of claim 1 having a mini traction machine (MTM) boundary traction coefficient lower than a marine lubricating oil including a Group I base stock which is substantially free of a cobase stock, substantially free of a molydithiocarbamate friction modifier, or substantially free of a zinc dithiocarbamate antiwear additive.

9. The marine lubricating oil of claim 1 having a fuel efficiency greater than a marine lubricating oil including a Group I base stock which is substantially free of a cobase stock, substantially free of a molydithiocarbamate friction modifier, or substantially free of a zinc dithiocarbamate antiwear additive.

10. A method of making a marine lubricating oil comprising the steps of:

providing a Group III base stock having a KV100 of 4 to 12 cSt, a cobase stock having a KV100 of 29 to 1000 cSt selected from the group consisting of a Group IV, and a Group V, a molydithiocarbamate friction modifier, a zinc dithiocarbamate anti-wear additive, a calcium alkyl salicylate detergent and other lubricating oil additives, and blending from 58.9 to 96.05 wt % of the Group III base stock, 16.37 to 33.28 wt % of a Group IV base stock or 0.7 to 17.0 wt % of a Group V base stock, 0.1 to 2.0 wt % of the molydithiocarbamate friction modifier, 0.6 to 2.0 wt % of the zinc dithiocarbamate anti-wear additive, 2.24 to 28 wt % of a calcium alkyl salicylate detergent and 0.29 to 0.50 wt % of the other lubricating oil additives to form the marine lubricating oil, and wherein the marine lubricating oil has a total base number (ASTM D2896) ranging from 8.5 to 103 and an MTM boundary traction coefficient (9 mm/s rolling speed) of less than or equal to 0.0413.

11. The method of claim 10, wherein the Group IV cobase stock is a Friedel-Crafts catalyzed PAO base stock or a metallocene catalyzed PAO base stock.

12. The method of claim 10, wherein Group V cobase stock is selected from the group consisting of polyisobutylene, polymethacrylate and combinations thereof.

13. The method of claim 10, wherein the Group III base stock is a GTL base stock.

14. The method of claim 10, wherein the oil has a KV100 ranging from 8.37 to 23 cSt.

15. The method of claim 10, wherein the other lubricating oil additives are selected from the group consisting of viscosity index improvers, antioxidants, dispersants, pour point depressants, corrosion inhibitors, metal deactivators, seal compatibility additives, anti-foam agents, inhibitors, anti-rust additives, other friction modifiers and other anti-wear additives.

16. The method of claim 10, wherein the oil is used in the marine diesel engine as a cylinder oil, a system oil or a trunk piston engine oil.

17. The method of claim 10, wherein the oil has a mini traction machine (MTM) boundary traction coefficient lower than a marine lubricating oil including a Group I base stock which is substantially free of a cobase stock, substantially free of a molydithiocarbamate friction modifier, or substantially free of a zinc dithiocarbamate antiwear additive.

18. The method of claim 10, wherein the oil has a fuel efficiency greater than a marine lubricating oil including a Group I base stock which is substantially free of a cobase stock, substantially free of a molydithiocarbamate friction modifier, or substantially free of a zinc dithiocarbamate antiwear additive.

* * * * *